US010975508B2

(12) United States Patent
Kim et al.

(10) Patent No.: US 10,975,508 B2
(45) Date of Patent: Apr. 13, 2021

(54) CLOTHING TREATMENT DEVICE

(71) Applicant: LG Electronics Inc., Seoul (KR)

(72) Inventors: Keunjoo Kim, Seoul (KR); Oshin Kwon, Seoul (KR); Jaeyong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 193 days.

(21) Appl. No.: 16/097,505

(22) PCT Filed: Apr. 27, 2017

(86) PCT No.: PCT/KR2017/004494
§ 371 (c)(1),
(2) Date: Oct. 29, 2018

(87) PCT Pub. No.: WO2017/188754
PCT Pub. Date: Nov. 2, 2017

(65) Prior Publication Data

US 2019/0145038 A1 May 16, 2019

(30) Foreign Application Priority Data

Apr. 27, 2016 (KR) ..... 10-2016-0051826

(51) Int. Cl.
*D06F 29/00* (2006.01)
*D06F 37/26* (2006.01)
(Continued)

(52) U.S. Cl.
CPC ..... *D06F 29/00* (2013.01); *D06F 31/00* (2013.01); *D06F 37/24* (2013.01); *D06F 37/26* (2013.01);
(Continued)

(58) Field of Classification Search
CPC ..... D06F 18/00; D06F 21/00; D06F 21/06; D06F 21/08; D06F 23/04; D06F 29/00;
(Continued)

(56) References Cited

U.S. PATENT DOCUMENTS 3,509,741 A * 5/1970 Morey ..... D06F 37/12 68/27
2015/0184326 A1 7/2015 Seo et al.

FOREIGN PATENT DOCUMENTS

CN 1224782 8/1999
CN 1389617 1/2003
(Continued)

OTHER PUBLICATIONS

PCT International Search Report and Written Opinion in International Appln. No. PCT/KR2017/004494, dated Aug. 9, 2017, 37 pages (with English Translation).
(Continued)

*Primary Examiner* — David G Cormier
(74) *Attorney, Agent, or Firm* — Fish & Richardson P.C.

(57) ABSTRACT

A laundry treating apparatus includes a tub; a first drum disposed within the tub; a second drum disposed in the first drum and configured to couple to the first drum and to perform washing separately from the first drum; and a water discharge mechanism mounted on the second drum. The water discharge mechanism includes: a seat portion extending radially inwardly from a side wall of the second drum; a water receiving hole defined in the seat portion for receiving washing water from the second drum; and a water-discharging hole defined in the side wall for discharging washing water to an outside. The water discharge mechanism is configured to selectively flow washing-water into the discharge mechanism through the water receiving hole or discharge washing-water to the outside through the
(Continued)

water-discharging hole, based on a magnitude of centrifugal force cause by rotation of the second drum.

21 Claims, 12 Drawing Sheets

(51) Int. Cl.

| | |
|---|---|
| ***D06F 39/12*** | (2006.01) |
| ***D06F 37/42*** | (2006.01) |
| ***D06F 37/24*** | (2006.01) |
| ***D06F 39/08*** | (2006.01) |
| ***D06F 31/00*** | (2006.01) |
| *D06F 37/12* | (2006.01) |
| *D06F 37/18* | (2006.01) |
| *D06F 23/04* | (2006.01) |

(52) U.S. Cl.
CPC ..... *D06F 37/42* (2013.01); *D06F 39/08* (2013.01); *D06F 39/12* (2013.01); *D06F 23/04* (2013.01); *D06F 37/12* (2013.01); *D06F 37/18* (2013.01); *D06F 39/083* (2013.01)

(58) Field of Classification Search
CPC ..... D06F 31/00; D06F 33/40; D06F 33/60; D06F 35/007; D06F 37/12; D06F 37/14; D06F 37/24; D06F 39/00; D06F 39/08; D06F 39/083; D06F 58/00; D06F 58/02; D06F 58/203; D06F 58/30; D06F 2202/00–12; D06F 2204/00–10; D06F 2204/065; D06F 2210/00; D06F 2212/00; D06F 2212/02; D06F 2212/04; D06F 2212/06; D06F 2214/00; D06F 2216/00; D06F 2220/00; D06F 2222/00; D06F 2224/00; D06F 2226/00
See application file for complete search history.

(56) References Cited

FOREIGN PATENT DOCUMENTS

| | | |
|---|---|---|
| CN | 1556880 | 12/2004 |
| CN | 2665174 | 12/2004 |
| CN | 101314905 | 12/2008 |
| CN | 102362027 | 2/2012 |
| CN | 205134011 | 4/2016 |
| JP | 51079175 | 12/1974 |
| JP | 54021064 | 7/1977 |
| JP | 5421064 | 2/1979 |
| JP | 5426700 | 9/1979 |
| KR | 2019960022740 | 7/1996 |
| KR | 100220753 | 9/1999 |
| KR | 1020010059865 | 7/2001 |
| KR | 1020030045447 | 6/2003 |
| KR | 100539506 | 2/2006 |
| KR | 1020150077059 | 7/2015 |
| KR | 1020150106680 | 9/2015 |
| WO | WO2003014454 | 2/2003 |
| WO | WO2015048870 | 4/2015 |
| WO | WO2015115827 | 8/2015 |

OTHER PUBLICATIONS

Chinese Office Action in Chinese Application No. 201780039883.9, dated Jun. 23, 2020, 21 pages (with English translation).
CN Office Action in Chinese Appln. No. 201780039883.9, dated Jan. 25, 2021, 14 pages (with English translation).

* cited by examiner

【FIG. 1】
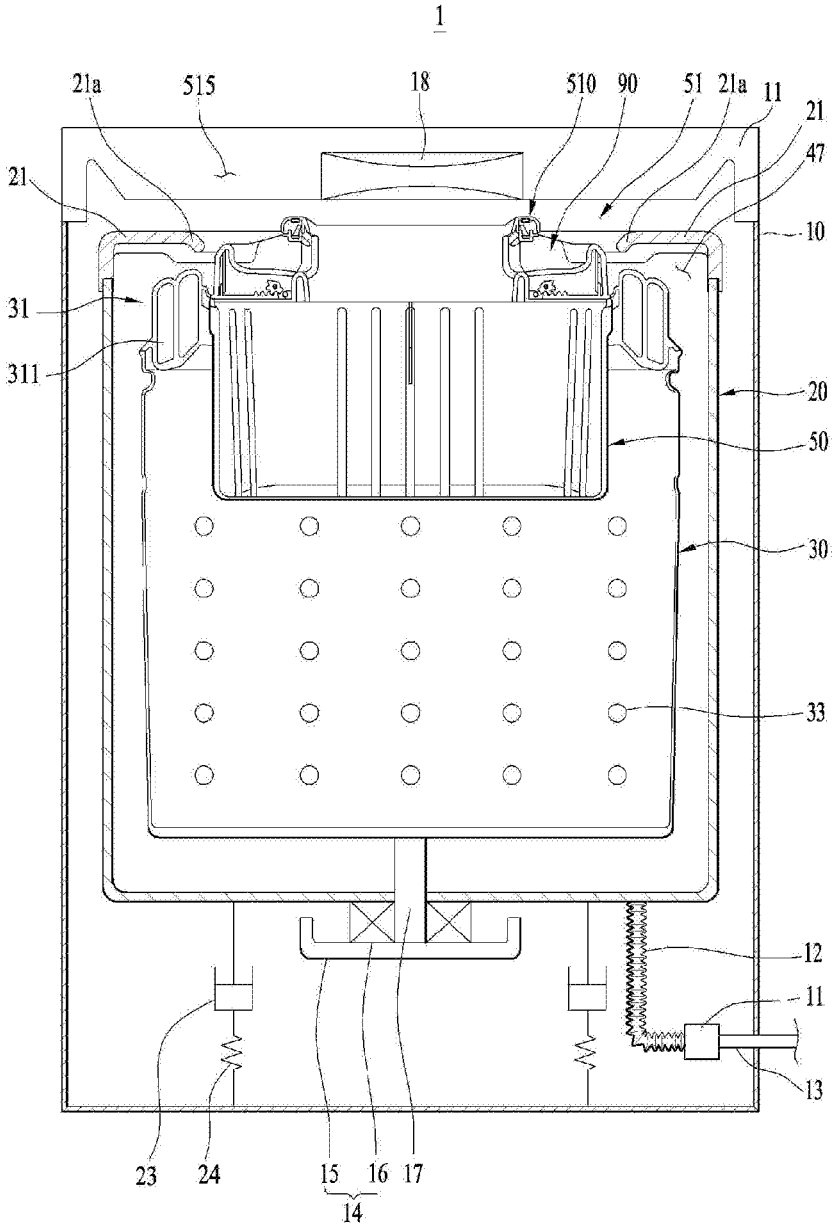

【FIG. 2】
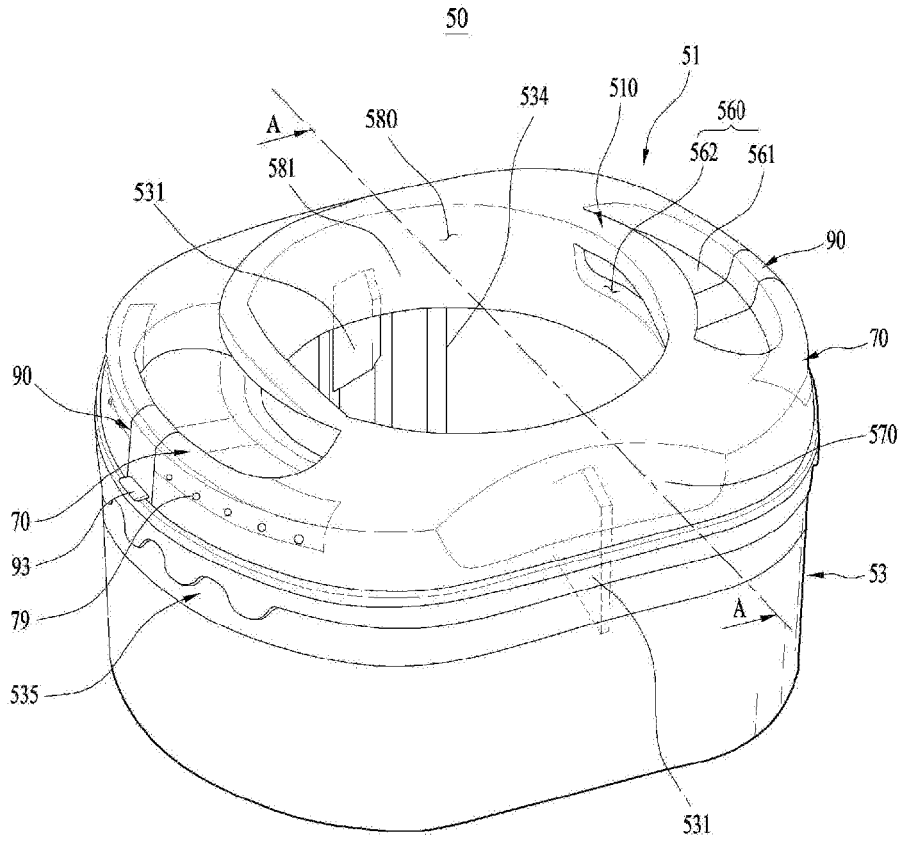

【FIG. 3】
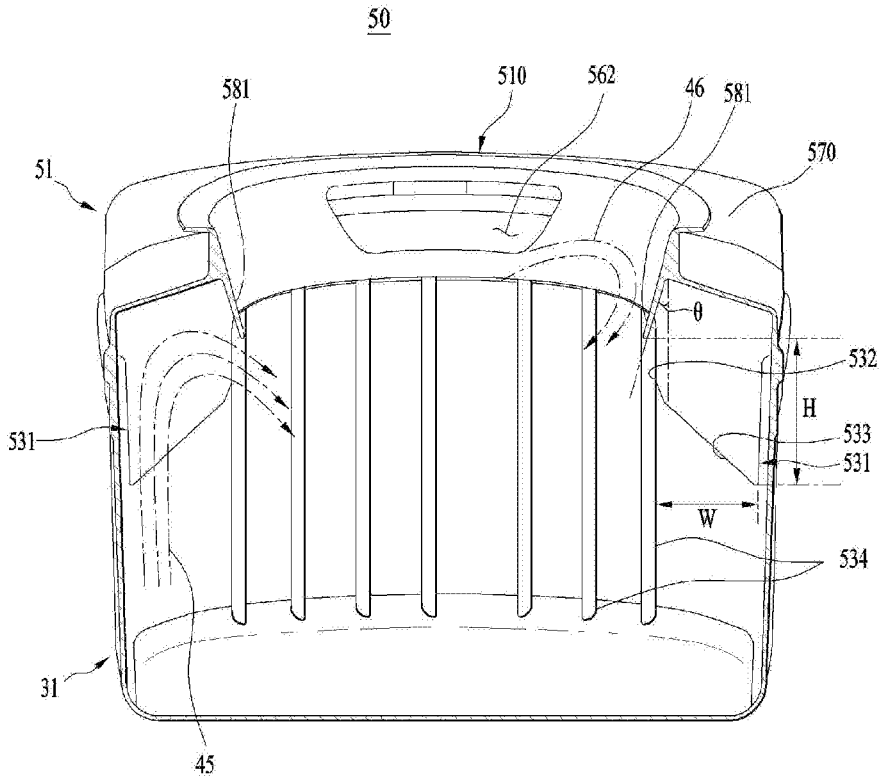

【FIG. 4】
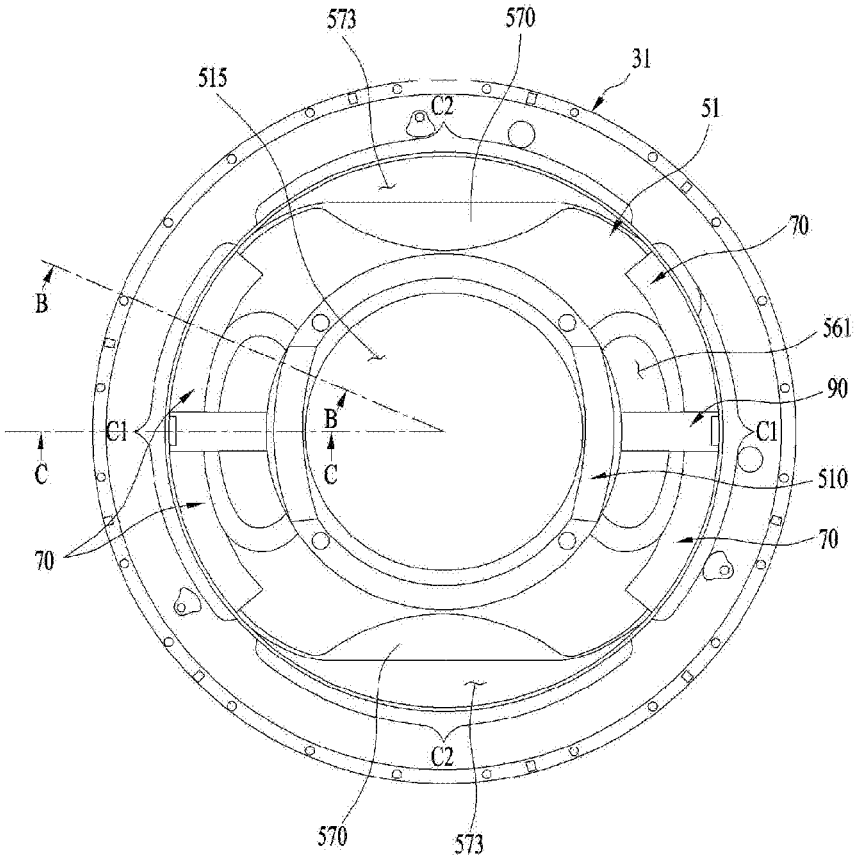

【FIG. 5】
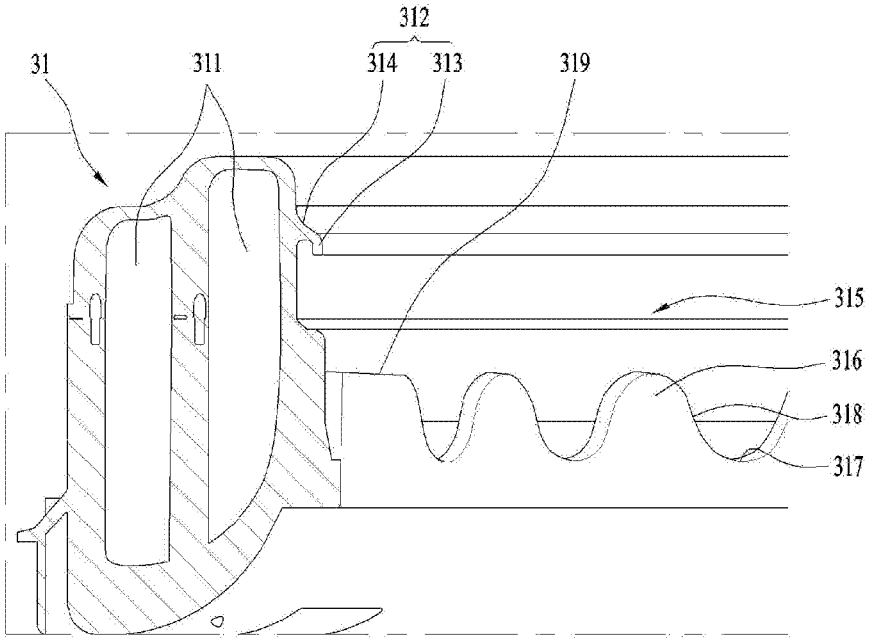

【FIG. 6】
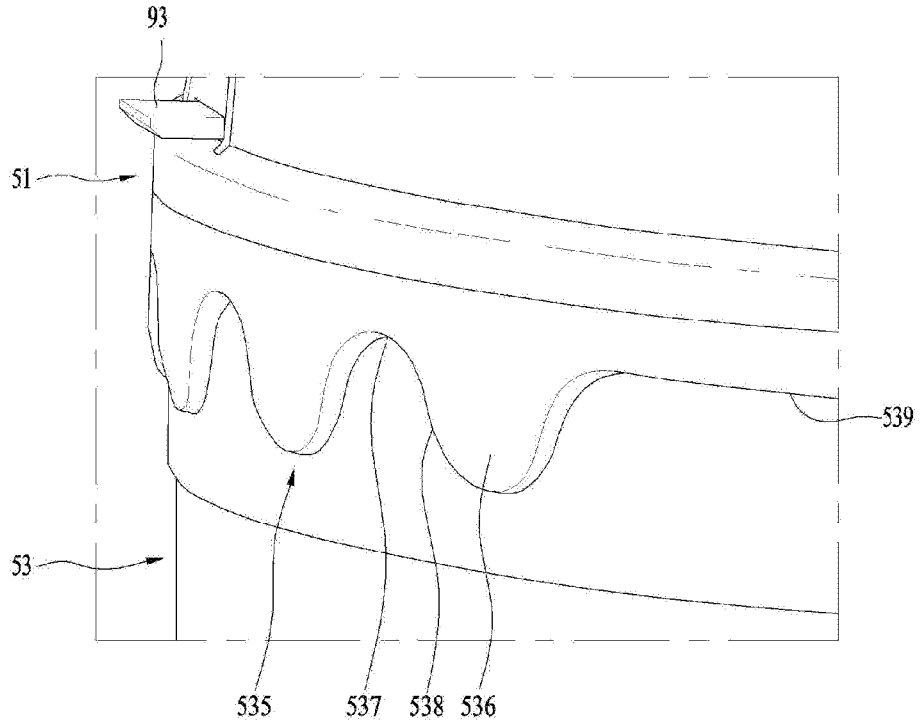

【FIG. 7】
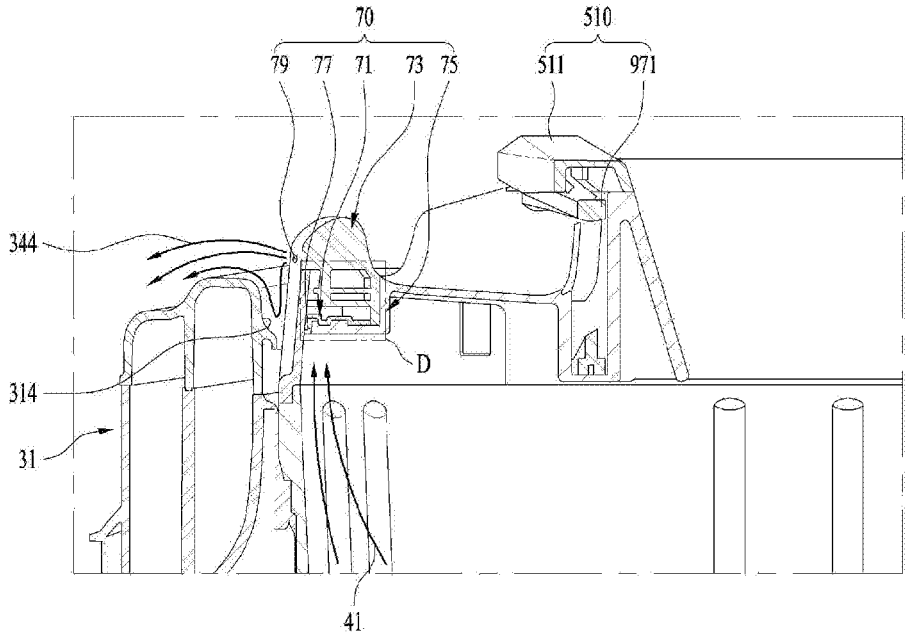

【FIG. 8】
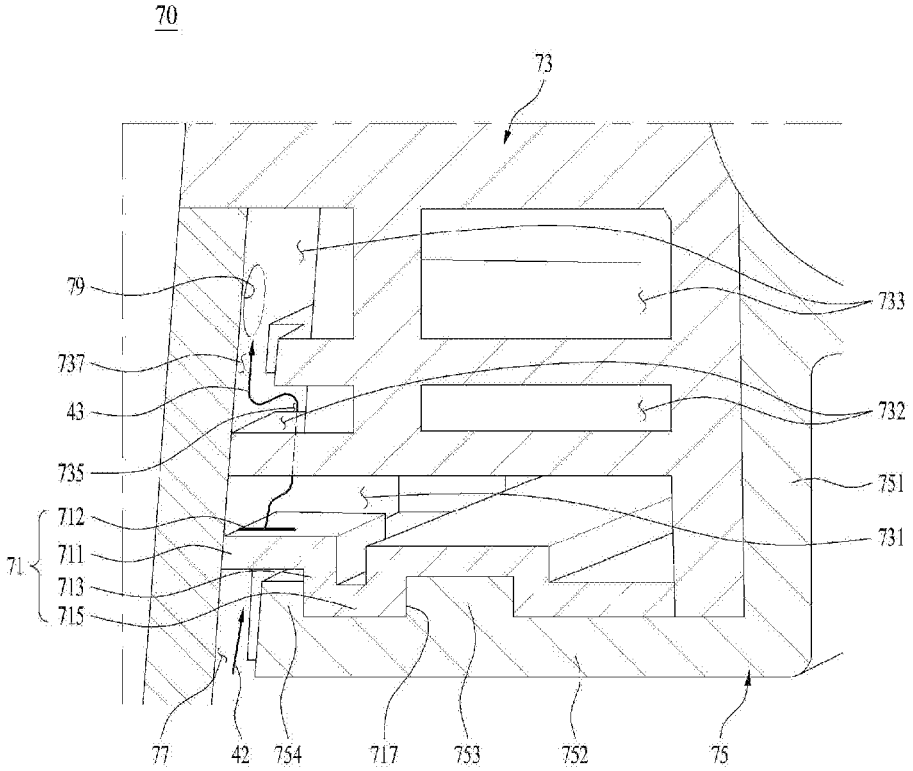

【FIG. 9】
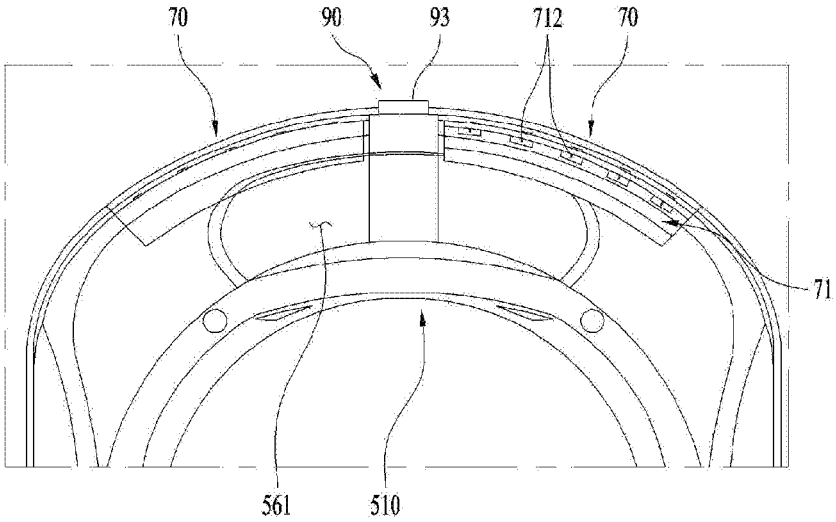

【FIG. 10】
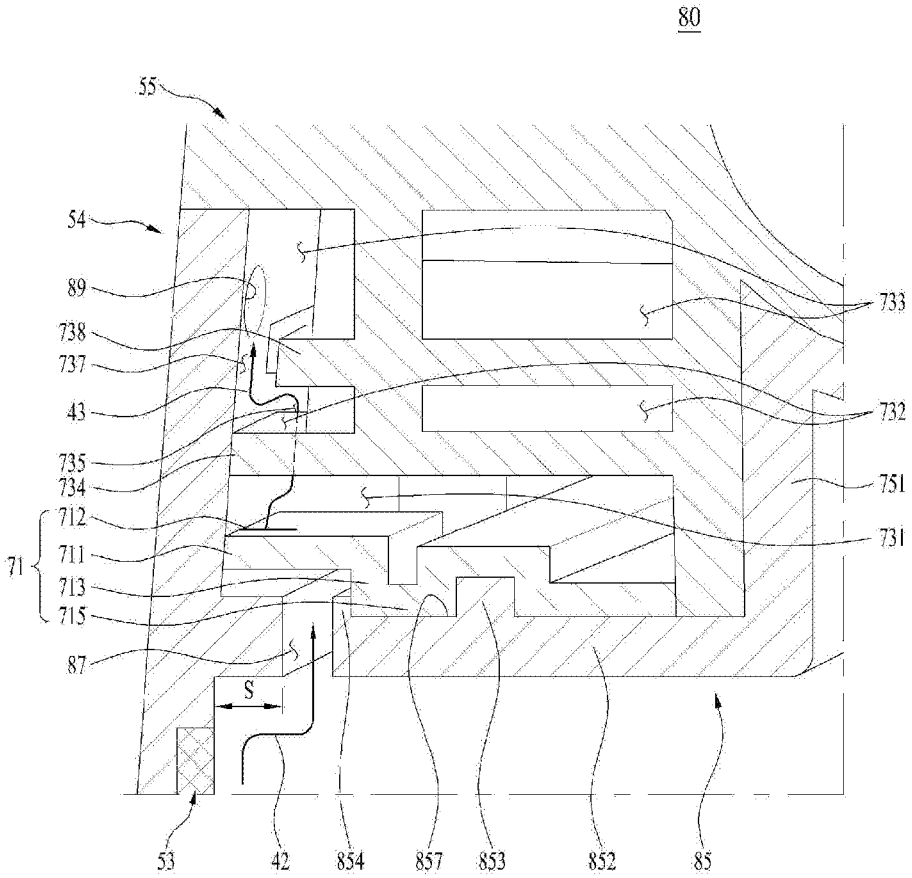

【FIG. 11】
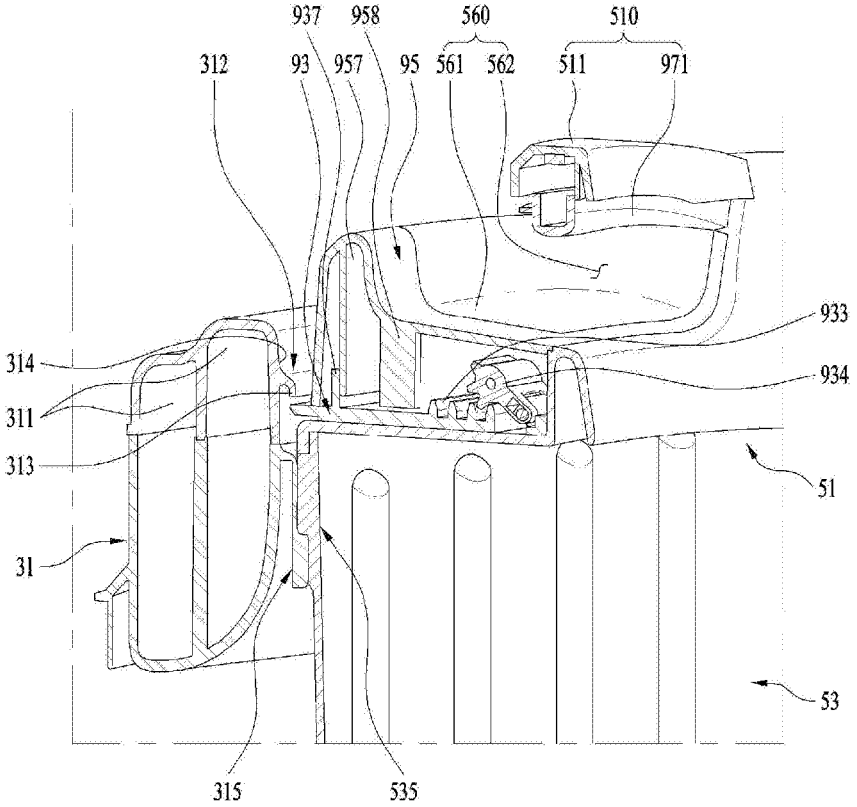

【FIG. 12】
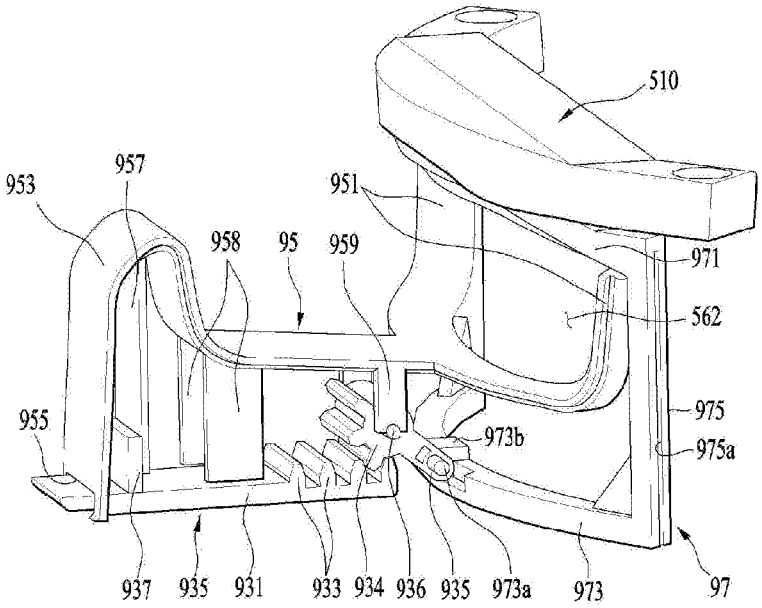

CLOTHING TREATMENT DEVICE

CROSS-REFERENCE TO RELATED APPLICATIONS

This application is a National Stage application under 35 U.S.C. § 371 of International Application No. PCT/KR2017/004494, filed on Apr. 27, 2017, which claims the benefit of Korean Application No. 10-2016-0051826, filed on Apr. 27, 2016. The disclosures of the prior applications are incorporated by reference in their entirety.

TECHNICAL FIELD

The present disclosure relates to a laundry treating apparatus, and more particularly, to a laundry treating apparatus in which an auxiliary drum is detachably installed inside a main drum so that washing in the auxiliary drum is separated from washing in the main drum.

BACKGROUND ART

Generally, the laundry treating apparatus includes a washing machine for performing washing, a dryer for performing drying, and a drying and washing machine for drying and washing together.

When the laundry treating apparatus is used as a washing apparatus, the laundry treating apparatus includes a cabinet which forms the appearance, a tub disposed inside the cabinet for receiving washing-water, a drum, which is rotatably installed in the tub and receives laundry, and a door coupled to the cabinet that allows the laundry to be injected and taken out.

The laundry treating apparatus may be divided into a top loading type in which the rotational axis of the drum is perpendicular to the ground and a front loading type in which the rotational axis of the drum is arranged to be parallel with respect to the ground.

In the front loading type, the rotational axis of the drum is formed substantially perpendicular to the ground. When the detergent, washing-water and laundry are injected into in the drum, the drum is rotated via receiving the driving force of the motor, and then the friction between the drum and the laundry and the falling impact of the laundry may allow washing to be performed in a drum washing manner. In this drum washing method, there occurs almost no damage to the laundry, and the laundry does not tangle, and the machine also taps and scrubs the laundry.

In the top loading type, the rotational axis of the drum is formed substantially perpendicular to the ground. The drum is provided inside the tub where washing-water is stored. Washing is performed in a pulsator manner in which washing is performed while the laundry is stored in the washing-water supplied in the drum. In the pulsator manner, washing is carried out by rotation of the drum, rotation of the pulsator provided under the drum and forming a water stream, friction between the washing-water and the laundry, and detergent reaction. Thus, washing-water must be supplied to a degree such that the laundry is submerged in the washing-water. Much washing-water may be consumed.

In the conventional laundry treating apparatus, the laundry washing process, i.e., the washing cycle, the rinsing cycle and the dewatering cycle, is performed in one drum. Accordingly, when the laundry is separated and washed according to the color or material of the laundry, at least two washing processes should be performed. Thus, the laundry treating apparatus operates more frequently, which causes washing-water, detergent and energy to be wasted.

Recently, there has been provided a washing machine provided with two drums in one body. That is, a large capacity drum and a small capacity drum are provided. The user may use one selected drum or both at the same time as needed. A washing process via the large capacity drum and a washing process via the small capacity drum are completely separated from each other, so that the use of the drums is convenient. In one example, in the case of a small amount of laundry, only the small capacity drum may be used, which is very economical.

However, such a washing machine is inevitably accompanied by an increase in product prices. Since the two drums are provided separately from each other, the size of the machine itself is inevitably increased. Therefore, there is a problem that a wider installation space is required than a space in which a conventional washing machine is installed. Furthermore, when a small drum is located under a large drum, there is a problem that the user has to bend downwardly excessively when using the small drum. Furthermore, when the small drum is placed above the large drum, there is a problem that it is difficult for the user with a small height to access the small drum.

In one example, according to Korean Patent Application Publication 2003-0045447 (hereinafter referred to as prior art), a laundry treating apparatus having an auxiliary drum detachably installed in the drum has been proposed in order to perform individual washing in one washing machine.

However, the auxiliary drum in the prior art has a small capacity. It is difficult to install a separate device for generating a vortex into the auxiliary drum. Since the frequency of the vortex occurrences due to rotation of the auxiliary drum is relatively low compared to that by the main drum. Thus, there is a problem that the washing power by the auxiliary drum is not sufficient.

Since a coupling portion between the auxiliary drum and the main drum is located at a relatively narrow space, there is a problem in that it is not easy for the user to mount the auxiliary drum at a correct position.

Furthermore, the auxiliary drum vibrates not only in the horizontal direction but also in the vertical direction at the time of high-speed rotation in order to perform the dewatering or spinning cycle, etc. Thus, there is a problem that the auxiliary drum may separate from the main drum.

Furthermore, in order that water is supplied to the main drum and the auxiliary drum, respectively, a water supply device for supplying water to the main drum and a water supply device for supplying water to the auxiliary drum are separately required. As a result, there is a problem that the volume of the laundry treating apparatus is increased and the manufacturing cost is increased.

Furthermore, the water is discharged to the inside of the main drum during the spinning process including a simple spinning in the washing process, that is, among the washing cycle, the rinse cycle and the spinning cycle by the auxiliary drum. That is, in the prior art, the washing processes in the main drum and the auxiliary drum are not substantially separated from each other.

Specifically, in the prior art, both the supply to the auxiliary drum and the supply to the main drum are performed via the auxiliary drum. Therefore, the detergent supplied to the auxiliary drum is supplied to the main drum. As a result, the washing effect in the auxiliary drum may be deteriorated. Furthermore, excessive detergent may be supplied to the main drum. Therefore, it is not easy to use proper amount of detergent in the auxiliary drum and main drum.

Depending on the type of the laundry, the type of detergent may vary. That is, the detergent supplied to the main drum and the detergent supplied to the auxiliary drum may be different from each other. However, in the prior art, the use of these different types of the detergents will not be acceptable.

When a small amount of highly contaminated mop is washed off in the auxiliary drum and large-capacity baby clothes are washed in the main drum, the washing water first wets the contaminated mop and then flows into the main drum. Likewise, the washing water discharged from the auxiliary drum first flows into the main drum and then is discharged out. Therefore, such a use manner will not be emotionally acceptable to the user. This problem may be caused by the fact that water supply, washing and drainage are not substantially separated between the auxiliary drum and the main drum.

In addition, in the prior art, it is not possible to additionally inject a sock-like laundry to the main drum. This is because the auxiliary drum is blocking the inlet to the main drum.

DISCLOSURE

Technical Purpose

The present disclosure basically aims at solving the above-mentioned prior art problems.

According to one embodiment of the present disclosure, there is provided a laundry treating apparatus in which an auxiliary drum is easily installed in a main drum and washing by the main drum and washing by the auxiliary drum may be separated from each other. In particular, the present disclosure provides a laundry treating apparatus in which the water supply and drainage may be substantially separated between the main drum and the auxiliary drum.

In accordance with one embodiment of the present disclosure, a laundry treating apparatus, which may obtain sufficient washing effect via the auxiliary drum is to be provided.

In accordance with one embodiment of the present disclosure, a laundry treating apparatus is to be provided in which an additional laundry is input to the main drum as well as the auxiliary drum.

In accordance with one embodiment of the present disclosure, there is to be provided a laundry treatment apparatus in which wash-water discharged from the auxiliary drum may not be introduced into the main drum, but may be effectively discharged out.

According to one embodiment of the present disclosure, there is to be provided a laundry treating apparatus, in which washing-water in the auxiliary drum is not discharged in the washing process whereas, only in the spinning process, the wash-water is discharged from the auxiliary drum. In particular, there is a need for a laundry treating apparatus which may implement drainage while separate driving means such as a drainage pump is not connected to the auxiliary drum.

Technical Solutions

In a first aspect of the present disclosure, there is provided a laundry treating apparatus comprising: a tub for receiving washing-water therein; a first drum rotatably disposed within the tub; and a second drum disposed in the first drum so as to be attachable or detachable to or from the first drum, wherein washing of a laundry by the second drum is performed separately from washing of a laundry by the first drum, wherein the second drum includes a water discharge mechanism configured to selectively discharge wash-water from the second drum based on a magnitude of a centrifugal force by rotation of the second drum.

The water discharge mechanism may be mounted on a top of the second drum such that wash-water rising along an inner circumferential face of the second drum is introduced into the water discharge mechanism and then discharged therethrough to the outside of the second drum.

The water discharge mechanism may include a check valve for selectively passing wash-water through the check valve; a chamber for applying flow resistance against the washing-water having passed through the check valve; and a through-hole.

The check valve may include: a shrinkable portion configured to be shrinkable by the centrifugal force; and a slit extending through the shrinkable portion, wherein when the shrinkable portion is shrunk, the slit is opened to communicate with the water receiving hole.

The slit may extend in a direction in which the centrifugal force acts.

The check valve may further include a rotatable portion connected to the shrinkable portion and rotating in a direction in which the centrifugal force acts.

The water discharge mechanism may include a chamber for receiving wash-water having passed through the check valve, a first through-hole through which washing water received in the chamber passes, and a second through-hole disposed abov the first through-hole for passing therethrough the water having passed through the first through-hole.

The chamber may include a first chamber for receiving wash-water having passed through the check valve, a second chamber disposed above the first chamber and communicating with the first chamber through the first through-hole; and a third chamber disposed above the second chamber and communicating with the second chamber through the second through-hole.

The first through-hole and the second through-hole may be defined at different longitudes.

The transverse section of the second drum may be formed in an elliptical shape to generate a swirling flow of washing-water.

An inner circumferential face portion of the second drum may include: a smaller spacing portion spaced from a center of rotation of the second drum by a first spacing; and a larger spacing portion spaced from the center of rotation by a second spacing greater than the first spacing.

The apparatus may further include a locking mechanism for engaging and disengaging the second drum with and from the first drum.

The water discharge mechanism may be mounted on the larger spacing portion.

The locking mechanism may include a stopper protruding from the inner circumferential face of the first drum; and fixing means are configured to be inserted into or withdrawn from the second drum, wherein when the fixing means is withdrawn from the second drum, the fixing means is interfered with the stopper to prevent an upward movement of the second drum.

The locking mechanism further may include a slidable portion, wherein while one side of the slidable portion is exposed upward of the second drum, the slidable portion is vertically slidably coupled to the second drum, wherein the fixing means may be inserted into or withdrawn from the second drum in conjunction with the up-and-down sliding movement of the slidable portion.

The locking mechanism may further include a rack formed on the top face of the fixing means; and a pinion engaging with the rack, wherein the pinion allows the fixing means to be inserted or withdrawn into or from the second drum via forward and reverse rotation associated with the up and down sliding movement of the slidable portion.

The pinion may include a pinion connector protruded so as to be rotatably connected to the slidable portion.

The second drum may include a handle portion for providing a grip space for a user to grip the second drum, wherein the slidable portion may be coupled to the handle portion to be inserted into or withdrawn from the handle portion.

In a second aspect of the present disclosure, there is provided a laundry treating apparatus comprising: a tub for receiving washing-water therein; a first drum rotatably disposed within the tub; a second drum disposed in the first drum so as to be attachable or detachable to or from the first drum, wherein washing of a laundry by the second drum is performed separately from washing of a laundry by the first drum; a water discharge mechanism mounted on the second drum, wherein when a magnitude of the centrifugal force due to the rotation of the second drum is greater than or equal to a predetermined value, the water discharge mechanism is configured to discharge washing-water from the second drum; and a locking mechanism for engaging and disengaging the second drum with and from the first drum.

In order to produce a vortex of wash-water, the second drum may have a first curvature portion having a predetermined curvature; and a second curvature portion having a curvature smaller than the curvature of the first curvature portion.

The water discharge mechanism may be disposed on a top of the second curvature portion such that washing-water rising along the inner circumferential face of the second drum enters into the mechanism and is discharged to the outside of the second drum.

The water discharge mechanism may include a check valve having a slit defined therein extending in a direction in which the centrifugal force acts; a chamber for applying a flow resistance against the washing-water having passed through the check valve; and a through-hole.

The apparatus further may include a handle portion mounted on the top of the second drum, wherein the handle portion may have, at one side thereof, an actuating portion which is inserted and withdrawn. The locking mechanism may realize engagement and disengagement between the first and second drums in conjunction with the insertion and withdrawal of the actuating portion.

In a third aspect of the present disclosure, there is provided a laundry treating apparatus comprising: a tub for receiving washing-water therein; a first drum rotatably disposed within the tub; a second drum disposed in the first drum so as to be attachable or detachable to or from the first drum, wherein washing of a laundry by the second drum is performed separately from washing of a laundry by the first drum; and a water discharge mechanism mounted on the second drum, wherein the water discharge mechanism includes: a seat portion extending radially inwardly from a side wall of the second drum; a water receiving hole defined in the seat portion for receiving the washing water from the second drum; and a water-discharging hole defined in the side wall of the second drum for discharging the washing water to an outside of the second drum, wherein the water discharge mechanism is configured to selectively allow the washing-water to flow into the discharge mechanism through the water receiving hole or allow the washing water received into the discharge mechanism through the water receiving hole to be discharged to an outside of the second drum through the water-discharging hole, based on a magnitude of a centrifugal force due to a rotation of the second drum.

The water discharge mechanism may be mounted on a top of the second drum such that wash-water rising along an inner circumferential face of the second drum is introduced into the water discharge mechanism and then discharged therethrough to the outside of the second drum.

The water discharge mechanism may include a bent flow channel constructed for lowering a flow pressure of the washing water.

The water discharge mechanism may include a chamber defining a space for receiving the wash-water introduced through the water receiving hole.

The chamber may include a plurality of chambers, wherein the plurality of chambers are arranged in a vertical direction.

The water discharge mechanism may have a plurality of through-holes defined to fluid-communicate the plurality of chambers with each other.

The water discharge mechanism may include a check valve configured for selectively passing therethrough the washing-water from the water receiving hole, based on the magnitude of the centrifugal force due to the rotation of the second drum.

The check valve may include:

a shrinkable portion configured to be shrinkable by the centrifugal force; and a slit extending through the shrinkable portion, wherein when the shrinkable portion is shrunk, the slit is opened to communicate with the water receiving hole.

The second drum may include:

a drum body for receiving laundry and washing-water; and a drum cover disposed on a top of the drum body, wherein the drum cover has a laundry inlet defined therein for receiving laundry.

The water-discharging hole may be located more radially inwardly of the second drum than the water receiving hole, wherein the water-discharging hole is located at a vertical level higher than a vertical level of the water receiving hole.

The water discharge mechanism may be mounted on the drum cover.

The water discharge mechanism may include a bent flow channel constructed to lower a flow pressure of the washing-water.

The water discharge mechanism may include a chamber defining a space for receiving the wash-water introduced through the water receiving hole.

The seat portion may be formed on an edge of the drum cover.

The water discharge mechanism may include a check valve configured for selectively passing therethrough the washing-water from the water receiving hole, based on the magnitude of the centrifugal force due to the rotation of the second drum.

The check valve may be seated on the seat portion.

The seat portion may be located below a top face of the drum cover.

The water receiving hole may contact the side wall of the second drum.

A transverse section of the first drum has a circular shape and a transverse section of the second drum has an elliptical shape, wherein an inner circumferential face portion of the second drum includes: a smaller spacing portion spaced from a center of rotation of the second drum by a first spacing; and a larger spacing portion spaced from the center of rotation by a second spacing greater than the first spacing, wherein the apparatus further includes: a locking mechanism for engaging and disengaging the second drum with and from the first drum, wherein the locking mechanism is mounted on the larger spacing portion; and a handle portion for providing a grip space for a user to grip the second drum, wherein the handle portion is mounted on the larger spacing portion.

The water discharge mechanism may be mounted on the larger spacing portion. The water discharge mechanism may not be mounted on the smaller spacing portion.

The water receiving hole may be located below the water-discharging hole and contacts an inner face of the side wall of the second drum, wherein the washing water rising up and flowing through the water receiving hole into the water discharge mechanism moves radially outwardly and then is discharged through the water-discharging hole out of the second drum.

The water receiving hole may include a plurality of circular holes or elongate slits arranged along a circumferential direction of the second drum.

The total area of the water receiving hole is smaller than the area of the bottom face of the seat portion where the washing-water collides. Thus, a first resistance is generated when washing-water is introduced into the water receiving hole. Furthermore, the water-discharging hole is positioned more radially and outwardly than the water receiving hole. Thus, when washing-water flows from the water receiving hole to the water-discharging hole, a second resistance is generated. Thus, at a washing RPM lower than the spinning RPM, washing-water is not discharged from the inside of the second drum. Furthermore, washing-water may be selectively discharged only in a predetermined spinning RPM band. This selective discharge may be realized without components to be controlled, such as a drain valve or a drain pump.

The water discharge mechanism may include the seat portion extending radially inwardly from an inner face of the side wall of the second drum, wherein the water-discharging hole is defined in the seat portion such that the water-discharging hole is radially inwardly spaced from the inner face of the side wall.

When the second drum receiving washing-water rotates, a first resistance may occur in which the washing-water moving radially outward and upward due to the centrifugal force overcomes the centrifugal force and moves radially inwards. The total area of the water receiving hole is smaller than the cross-section area of the flow generated when the water moves radially inwards. Thus, when the washing-water flows into the water receiving hole, a second resistance may occur. Thereafter, since the water-discharging hole is positioned more radially outwardly than the water receiving hole, a third resistance may occur when the water flows from the water receiving hole to the water-discharging hole. In this connection, the second resistance and the third resistance are further increased as the water receiving hole is further spaced from the side wall of the second drum. Thus, changing the spacing may allow controlling a spinning RPM at which the water drain at the spinning cycle is performed.

The water-discharging hole may have a slit shape, wherein a dimension of the slit in a circumferential direction of the second drum is larger than a dimension of the slit in a vertical direction. It is preferable that the slit is defined to be long in the direction of rotation of the second drum so that the wash-water flowing into the water-discharging hole while overcoming the flow resistances may be smoothly and continuously discharged by the centrifugal force.

Technical Effects

The washing machine according to the embodiments of the present disclosure has the following effects.

First, according to one embodiment of the present disclosure, the laundry washing process by the main drum and the laundry washing process by the auxiliary drum are performed by one drive unit and may be performed separately from each other.

Second, according to one embodiment of the present disclosure, the wash water may be supplied to the main drum and auxiliary drum, respectively, from a single water supply. This may not only reduce the volume of the laundry treating apparatus, but may also have the effect of reducing manufacturing costs.

Third, according to one embodiment of the present disclosure, in the washing process, washing water in the auxiliary drum may not be discharged therefrom while, tashing water in the auxiliary drum may be discharged out only in the spinning process. In particular, this discharge may be implemented without separate drive means such as a drain pump connected to the auxiliary drum.

Fourthly, according to one embodiment of the present disclosure, a vortex is sufficiently generated inside the auxiliary drum via rotation of the auxiliary drum without a separate vortex generator, thereby improving the washing power.

Fifth, according to one embodiment of the present disclosure, concave and convex portions of each of the convex-concave portions formed on the outer circumferential surface of the auxiliary drum and on the inner circumferential face of the main drum and having a plurality of alternated concave and convex portions may have a considerably gentle inclination angle. As a result, interference between the concave portion and the convex portion may be minimized when the user mounts the auxiliary drum on the main drum.

Sixth, according to one embodiment of the present disclosure, the auxiliary drum may not be separated from the main drum during a high-speed rotation of the auxiliary drum. The mere grip of the handle by the user may allow engaging and disengaging the auxiliary drum with and from the main drum.

BRIEF DESCRIPTION OF THE DRAWINGS

FIG. 1 is a schematic cross-sectional view of a laundry treating apparatus according to one embodiment of the present disclosure.

FIG. 2 is a perspective view of a second drum shown in FIG. 1.

FIG. 3 is a cross-sectional view along a line A-A shown in FIG. 2.

FIG. 4 is a top view of the second drum mounted in a first drum.

FIG. 5 is a partial cutaway perspective view showing an inner circumference of a first drum cover to illustrate a first convex-concave portion.

FIG. 6 is a partial perspective view of an outer circumference of the second drum to illustrate a second convex-concave portion.

FIG. 7 is a partial cross-sectional view along a line B-B shown in FIG. 4 to illustrate a water discharge mechanism.

FIG. 8 is an enlarged view of a part D of FIG. 7 to illustrate an example of a water discharge mechanism.

FIG. 9 is a partial cut-away plan view to illustrate the water discharge mechanism shown in FIG. 8.

FIG. 10 is an enlarged view of a part D of FIG. 7 to illustrate another example of a water discharge mechanism.

FIG. 11 is a partial cross-sectional view along a line C-C shown in FIG. 4 to illustrate a locking mechanism.

FIG. 12 is a perspective view illustrating the locking mechanism.

BEST MODE FOR CARRYING OUT THE INVENTION

Hereinafter, a drum washing machine and a method for cleaning a tub 20 of the drum washing machine according to various embodiments of the present disclosure will be described in detail with reference to the drawings. Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims. In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure. For simplicity and clarity of illustration, elements in the figures are not necessarily drawn to scale. The same reference numbers in different figures denote the same or similar elements, and as such perform similar functionality.

Terms "first" and "second" used herein may be used to describe various components, but the components should not be limited by the terms. The terms are used only for the purpose of distinguishing one component from another component.

Moreover, terms used herein are used only to describe a specific embodiment and are not intended to limit a protection scope of the present disclosure. The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof.

FIG. 1 is a schematic cross-sectional view of a laundry treating apparatus 1 according to one embodiment of the present disclosure.

Referring to FIG. 1, the laundry treating apparatus 1 according to one embodiment of the present disclosure includes a cabinet 10 with a top opening so that laundry can be injected into the cabinet, a door (not shown) for opening or closing the top opening of the cabinet 10, a tub 20 installed inside the cabinet 10 for storing wash-water therein, a motor 14 installed on the tub 20 for generating a driving force, a rotation shaft 17 connected to the motor 14, a first drum 30 connected to the rotation shaft 17 for washing the laundry using the driving force transmitted from the motor 14, and a second drum 50 detachably installed in the first drum 30, wherein washing by the first drum 30 is independent from washing by the second drum 30.

As used herein, washing water for washing and cleaning water for cleaning the door are all called the washing-water. The first drum 30 may be called the main drum, and the second drum 50 may be called the auxiliary drum.

In FIG. 1, a direct drive structure is shown in which the motor 14 is directly connected to the rotation shaft 17 and drives the first drum 30. However, the laundry treating apparatus 1 according to one embodiment of the present disclosure is not necessarily limited thereto.

The cabinet 10 forms the appearance of the laundry treating apparatus 1. The cabinet includes a cabinet cover 11 having an opening defined therein for communicating the inside and the outside of the cabinet 10 for the injection of laundry into the cabinet.

A cabinet cover 11 is provided at a top of the cabinet 10. A door (not shown) is rotatably provided at the cover so as to selectively open and close the opening. Accordingly, the user may open and close the door to put laundry in the first drum 30 and the second drum 50 or remove laundry from the insides of the first drum 30 and the second drum 50.

In one example, a water supply 18 is formed in the cabinet cover 11 to supply water containing detergent or clean water free of detergent to the first drum 30 and the second drum 50. The washing-water discharged from the water supply 18 is selectively supplied to the first drum 30 or to the second drum 50 through the inside of the tub 20, depending on the rotation of the second drum 50 to be described later.

The tub 20 has a cylindrical shape having an open top, and is formed to receive the washing water while being housed in the cabinet 10. The tub 20 includes the tub cover 21, which is mounted at the top thereof.

In the tub cover 21, a laundry inlet 580 is formed in a position corresponding to the opening of the cabinet 10 so that the first drum 30 and the second drum 50 communicate with the outside. As used herein, the first drum 30 may be referred to as a main drum 30 while the second drum 50 may be referred to as an auxiliary drum 50.

In one example, the tub cover 21 includes a cover bent portion 21*a* formed on the inner circumferential surface of the laundry inlet 580 and formed to be inclined downward toward the inside of the tub cover 21.

The cover bent portion 21*a* guides the washing water which has circulated upwardly along the inner circumferential surface of the tub 20 due to the rotational force of the first drum 30 to be injected through the top of the first drum 30 and fall into the first drum 30. At this time, it is preferable that the second drum 50 is not mounted in the first drum 30.

The tub 20 is elastically supported at a bottom face thereof by a spring 24 and a damper 23 installed in the cabinet 10. Furthermore, since the tub 20 is directly supported at the bottom face thereof by the spring 24 and the damper 23, the tub itself cannot rotate. Therefore, unlike the first drum 30, the tub 20 does not receive a separate rotational force from the motor 14. In FIG. 1, a configuration is illustrated in which the spring 24 and the damper 23 are connected in series to the bottom face of the tub 20, but the present disclosure is not limited thereto. The spring 24 and the damper 23 may be connected to the tub in a parallel manner, if necessary. Alternatively, the damper 23 may be connected to the bottom face of tub 20 and the spring 24 may be connected to the top face of tub 20. A opposite configuration is also possible.

Furthermore, a water-discharge system is connected to the bottom face of tub 20 to drain the water. The water-discharge system includes a drain pump 11 that provides power to discharge washing-water received in the tub 20; a first discharge pipe 12 having one end connected to a bottom of the tub, and the other end connected to the drain pump 11, wherein the first discharge pipe 12 guides the washing water received in the tub 20 to the drain pump 11; and a second discharge pipe 13 having one end connected to the drain pump 11 and the other end connected to the cabinet, wherein the second discharge pipe 13 discharges washing-water from the drain pump 11 to the outside of the cabinet 10. The first discharge pipe 12 may be embodied as a bellows tube so that the vibration of the tub 20 is not transmitted to the drain pump 11.

While the first drum 30 is rotatably mounted within the tub 20, the laundry is injected into the first drum. The first drum 30 is formed into a cylindrical shape whose upper end is open and whose transverse section shape is substantially circular. The rotation shaft 17 connected to the motor 14 composed of a rotor 15 and a stator 16 is directly connected to the bottom face of the first drum. Thus, the first drum receives rotational force from the motor 14.

In this connection, the motor 14 may be provided with a clutch (not shown). Accordingly, the driving force may be selectively transmitted to the first drum 30 and a pulsator (not shown) provided below the first drum 30. For example, as, with the rotation shaft 17 being fixed to the pulsator, the rotation shaft is selectively coupled to the first drum 30, the drive unit 14 may transmit the driving force to the pulsator or may transmit the driving force to both the pulsator and the first drum 30. In another example, as, with the rotation shaft 17 being fixed to the first drum 30, the shaft is selectively coupled to the pulsator, the drive unit 14 may transmit a driving force to the first drum 30 or a driving force to both the pulsator and the first drum 30.

The configuration in which the rotation shaft 17 is fixed to one of the pulsator and the first drum 30, while the rotation shaft 17 is selectively coupled to the other of the pulsator and the first drum 30 has been described. However, the disclosure is not limited thereto. A configuration in which the rotation shaft 17 is selectively coupled to only one of the pulsator and the first drum 30 is not excluded.

The first drum 30 is formed into a cylindrical shape having an open top and a generally circular cross-section. A upper portion of the first drum 30 is formed into an open cylindrical shape. A plurality of through-holes 33 are formed in the sidewall of the first drum, that is, the circumferential surface portion. The first drum 30 communicates with the tub 20 through the plurality of through-holes 33. Accordingly, when the washing water is supplied to the tub 20 at a certain level or higher in the tub, the first drum 30 is submerged in the washing water, and, then, a portion of the washing water is injected into the first drum 30 through the holes 33.

The first drum 30 includes a first drum-cover 31 provided on its top.

The first drum-cover 31 is formed in a shape of a ring having a hollow portion and is disposed below the tub cover 21. In one embodiment, a water discharge channel 47 may be defined between a top face of the drum-cover 31 and a bottom face of the tub cover 21. The water discharge channel 47 guides the washing-water discharged to the outside through a side face of a top of the second drum 50 to the inside of the tub 20.

In the first drum-cover 31, an opening is formed through which the laundry is inserted. The second drum 50 may be mounted through the opening. Further, inside the first drum-cover 31, there is provided a balancer 311 which eliminates the imbalance caused by the laundry biasing in the first drum 30. The first drum cover 31 includes a first convex-concave portion 315 formed on the inner circumferential surface thereof so that the second drum 50 is detachable from or attachable to the first drum. In addition, the first drum cover 31 includes a stopper 312 formed on an inner circumferential surface of the first drum cover 31 so as to interfere with fixing means 93 of the second drum 50 seated on the first convex-concave portion 315 to prevent upward movement of the first drum 30. The first convex-concave portion 315 and the stopper 312 will be described in detail later.

Hereinafter, the second drum 50 will be described in detail with reference to FIGS. 2 to 4.

FIG. 2 is a perspective view of the second drum 50 shown in FIG. 1. FIG. 3 is a cross-sectional view along a line A-A shown in FIG. 2. FIG. 4 is a top view of the second drum 50 mounted on the first drum 30.

Referring to FIG. 2 to FIG. 4, the second drum 50 is configured to be detachable or attachable from or to the inside of the first drum 30 and is provided on a top of the first drum 30. The second drum 50 is formed into a cylindrical shape whose a top is open and whose a transverse section is approximately elliptical. However, the configuration that the transverse section of the second drum 50 is formed into an approximately elliptical shape may be one example of a configuration in which one side of an outer circumferential surface of the second drum 50 is engaged with an inner circumferential surface of the first drum 30, while the other side of the outer circumferential surface of the second drum 50 spaced from said one side of the outer circumferential surface of the second drum 50 in a rotational direction of the second drum 50 is spaced from the inner circumferential surface of the first drum 30. As long as this configuration is achieved, the transverse section of the second drum 50 may be formed in any shape. Hereinafter, for convenience of illustration, the transverse section of the second drum 50 is described as being formed in the elliptical shape. However, the present disclosure is not limited thereto.

The second drum 50 is configured to perform a washing process that includes watering, washing, rinsing, spinning and draining separately from the first drum 30. Accordingly, the laundry is classified according to the color or the material and is then divided and input into the first drum 30 and the second drum 50, and is washed simultaneously by the first drum and the second drum. Thus, washing-water, detergent, and energy waste can be prevented while the number of operations of the laundry treating apparatus 1 is reduced. The second drum 50 receives the rotational force from the first drum 30 to rotate and perform the washing. Therefore, the second drum does not require a separate driving device.

The second drum 50 includes a second drum body 53 with an open top, a second drum cover 51 detachably coupled to the top of the second drum body 53, a water discharge mechanism 70 for discharging the washing-water inside the second drum 50 to the outside during the high-speed rotation of the second drum 50, and a locking mechanism 90 for engaging and disengaging the second drum 50 seated in the first drum 30 with the first drum 30.

The second drum body 53 is formed in an elliptical shape at a transverse section thereof so as to form a swirling flow of washing water. On the inner circumferential surface of the drum body, a friction rib 534 is provided to generate the flow of the washing water.

In the case of a top loading type such as the laundry treating apparatus 1 according to one embodiment of the present disclosure, Not only is washing done by the chemical action of the detergent but also washing occurs due to friction between washing-water and laundry caused by water flow generated by the drum rotation and the like. Since the second drum body 53 has a substantially elliptical transverse section, the second drum body generates a vortex more effectively via rotation than a drum having a transverse section formed in a circular shape. The friction between washing-water and laundry may increase via the vortex. Thus, the washing ability may be increased using the elliptical transverse section of the second drum 50.

In one embodiment, as shown in FIG. 4, the inner circumferential face of the second drum 50 may be divided into a first curvature portion C1 formed to have a first curvature and a second curvature portion C2 formed to have a second curvature smaller than the first curvature.

A pair of first curvature portions C1 are provided at opposite sides of the circumferential surface of the second drum body 53, respectively. The first curvature is formed to correspond to the curvature of the circumferential surface of the opening formed in the first drum cover 31.

A pair of second curvature portions C2 are provided at opposite sides of the circumferential surface of the second drum body 53. Each second curvature portion C2 is located between the pair of first curvature portions C1. The second curvature is formed to be smaller than the first curvature.

The inner circumferential face of the second drum body 53 may include a smaller spacing portion C2 spaced by a first distance from a rotation center of the second drum 50, and a larger spacing portion C1 spaced by a second distance greater than the first distance from the rotation center of the second drum 50. In this case, the larger spacing portion C1 corresponds to the first curvature portion C1, while the smaller spacing portion C2 corresponds to the second curvature portion C2.

In one embodiment, the smaller spacing portion C2 and the inner circumferential face of the drum-cover 31 are spaced apart from each other by a sufficient distance. Thus, a first water-supply channel 573 to be described later is formed.

In the above embodiment, the second curvature portion C2 of the inner circumferential surface of the second drum body 53 is formed as a curved surface. The present disclosure is not limited thereto. The second curvature portion C2 may have a flat surface rather than a curved surface. When the second curvature portion C2 has a flat face, a name of the second spacing portion C2 may be more appropriate than a name of the second curvature portion C2.

As used herein, the first curvature portion C1, the second curvature portion C2, the larger spacing portion C1, the smaller spacing portion C2, the contact portion C1 and the spaced portion C2 indicate the specific regions of the second drum 50. When a specific region is included in the specific region of the second drum 50, the specific region may be named using the above term. As used herein, portions of the second drum body 53 and the second drum cover 51 are designated using the above terms.

The through-holes 33 are not provided in the circumferential face of the second drum body 53, unlike the case in which the through-holes 33 are provided in the circumferential face of the first drum 30. Thus, the second drum body 53 may accommodate the washing water and the laundry therein. The washing water is not discharged into the first drum 30 through the circumferential face or the lower face. Thus, the washing water contained in the tub 20 is only injected into the first drum 30 through the through-holes 33 while the washing water is not injected into the second drum 50.

The friction ribs 534 protrude from the inner circumferential face of the second drum body 53 and extend up and down. The plurality of friction ribs 534 are spaced apart at regular intervals. The ribs may be formed integrally with the second drum body 53. During the rotation of the second drum body 53, the washing water is rotated in the direction of rotation of the second drum body 53 by the friction force between the washing water and the friction ribs 534. The friction rib 534 is different in shape and function from a guide rib 531 to be described later.

The second drum cover 51 is coupled to the top of the second drum body 53. The transverse section of the second drum cover 51 is identical with the transverse section of the second drum body 53.

Thus, the circumferential surface of the second drum cover 51 is divided into a first curvature portion C1 and a second curvature portion C2. The first curvature portion C1 may be referred to as a larger spacing portion C1. The second curvature portion C2 may be referred to as a smaller spacing portion C2. Furthermore, unlike the first curvature portion C1 and the second curvature portion C2 of the second drum body 53, the first curvature portion C1 of the second drum cover 51 contacts the inner peripheral surface of the first drum cover 31. Thus, the first curvature portion C1 of the second drum cover 51 may be designated as the contact portion C1. The second curvature portion C2 is spaced from the inner circumferential surface of the first drum cover 31. Thus, the second curvature portion C2 may be referred to as a spaced portion C2.

The second drum cover 51 may include a laundry inlet 580 formed in the top face thereof for the laundry input therein, and an inclined guide 581 formed along the inner circumferential face of the laundry inlet 580. The second drum cover 51 further includes a handle portion 510 that provides a space for the user to grip. The second drum cover 51 may further include an inner water-supply guide 560 for guiding the washing water discharged from the water supply 18 to the inside of the second drum 50. Further, the second drum cover 51 may include an outer water-supply guide 570 for guiding the washing water discharged from the water supply 18 to the inside of the first drum 30 through the outside of the second drum 50. The second drum cover 51 may include a guide rib 531 configured such that the washing water circulating along the inner circumferential face of the second drum body 53 changes its direction of flow via the collision with the guide rib 531 and is pulled upwards to a top and then falls from the top to the center of the second drum body 53.

A pair of handle portions 510 are formed on the top face of the second drum cover 51. The handle portion 510 includes a handle body 511 extended by a predetermined length, and an actuating portion 971 disposed movably in an up and down direction within the handle body 511. The actuating portion 971 acts as a first curved portion 971 which constitutes a second frame 97 of a locking mechanism 90 which will be described later.

The handle portion 510 is provided adjacent the first curvature portion C1 of the second drum cover 51, i.e., the larger spacing portion C1 thereof. The impact occurring in separating the second drum 50 from the first drum 30 may cause the washing water to be biased toward one side. In this case, the second drum 50 may vibrate in an up and down direction. Thus, when the handle portion 510 is provided adjacent to the second curvature portion C2, i.e., the smaller spacing portion C2, the user has to apply a lot of force to suppress the vertical vibration of the second drum 50. For this reason, the handle portion 510 is advantageously provided adjacent to the larger spacing portion C1.

The inner water-supply guide 560 is provided in the top face of the second drum cover 51. The guide 560 is provided adjacent to the larger spacing portion C1, i.e., the contact portion C1. The inner water-supply guide 560 includes a recess 561 and a water-supply hole 562.

The recess 561 is formed by recessing a part of the top face of the second drum cover 51 so that after the washing water discharged from the water supply 18 collides with the top face of the second drum cover 51, the water does not scatter around the top face of the second drum cover 51.

The water-supply hole 562 is formed on the inner face of the recess 561 with facing the laundry inlet 80. The hole 562 may be formed to communicate the laundry inlet 580 and the recess 561. Thus, as the washing water is guided from the recess 561 through the water-supply hole 562 to the laundry inlet 580, the water-supply hole 562 forms a second water-supply channel 562 that guides the washing water to the second drum 50.

Thus, the washing water as discharged from the water supply 18 is temporarily stored in the recess 561 so that it is not scattered around the second drum cover 51. Thereafter, the wash water is discharged through the water-supply hole 562, i.e., the second water-supply channel 562, into the laundry inlet 580 and then into the second drum 50.

In one embodiment, the recess 561 and the water-supply hole 562 are formed under the handle portion 510. This maximizes the space efficiency of the second drum cover 51.

The outer water-supply guide 570 is provided on the second drum cover 51. The guide 570 is provided adjacent to the smaller spacing portion C2, that is, the spaced portion C2. That is, the outer water-supply guide 570 is spaced from the inner water-supply guide 560. The second drum 50 rotates together with the first drum 30 by a predetermined angle such that each of the inner water-supply guide 560 and the outer water-supply guide 570 is positioned below the single water supply 18. Therefore, although the outer water-supply guide 570 is provided separately from the inner water-supply guide 560, the washing water discharged from the single water supply 18 may be supplied to the first drum 30 and the second drum 50, respectively.

The outer water-supply guide 570 may be formed by recessing the edge portion of the spaced portion C2 toward the inside of the second drum cover 51. The outer water-supply guide 570 has a bottom face as an outwardly and downwardly sloping face. Thus, when the washing water is discharged from the water supply 18, the washing water is guided to the inside of the first drum 30 through the first water-supply channel 573 defined as a space formed between the spaced portion C2 and the outer peripheral surface of the first drum 30.

The guide rib 531 is formed in a plate shape and is provided below the top face of the second drum cover 51 and extends downward. Further, the guide rib 531 is provided such that one side thereof contacts the inner circumferential face of the second drum body 53. In other words, the plate-shaped guide rib 531 has its upper side engaged with the second drum cover 51 and its one side contacting the inner circumferential face of the second drum body 53. Accordingly, the washing water inside the second drum body 53 may be rotated along the inner circumferential face of the second drum body 53 by the rotational force of the second drum 50, and, then, the washing water may flow upward due to the collision with the guide rib 531, and, then, the washing water may drop along a parabolic curve toward the center of the second drum 50.

Specifically, the guide rib 531 includes a rib vertical portion 532 formed on one side face toward the center of the second drum body 53 and extending downward from the top face of the second drum cover 51, and a rib inclined portion 533 formed on the bottom face toward the bottom of the second drum body 53, wherein the portion 533 extends from the rib vertical portion 532 downwardly toward the inner circumferential face of the second drum body 53.

The rib inclined portion 533 forms an acute angle with the inner circumferential face of the second drum body 53. The portion 533 is formed to be spaced apart from the bottom face of the second drum body 53.

As the rib inclined portion 533 is formed on the bottom face of the guide rib 531, the laundry that rotates together with the washing water inside the second drum body 53 is less interfered. Thus, the laundry flows more smoothly. This may increase the friction between the laundries and, thus, increase the washing power.

In one embodiment, even when the guide rib 531 includes the rib inclined portion 533, a sufficient amount of the washing water may be elevated. For example, when the second drum 50 rotates at high speed, the water level of the washing water on the inner circumferential face of the second drum body 53 is higher than the water level of the washing water in the center of the second drum body 53. Therefore, even when the guide rib 531 has the rib inclined portion 533, the sufficient amount of the washing water may rise up via colliding against the guide rib 531.

In one embodiment, when the second drum 50 rotates at a relatively low speed, a sufficient amount of the washing water can be raised up by placing the guide rib 531 in the smaller spacing portion C2 of the second drum cover 51. The amount of the washing water passing through the imaginary cross section from the center of the second drum body 53 to the smaller spacing portion C2 may be equal to the amount of washing water passing through the imaginary cross-section from the center of the second drum body 53 to the larger spacing portion C1.

A distance between the inner wall of the second drum 50 and the center of the drum in the smaller spacing portion C2 is shorter than that in the larger spacing portion C1. In one example, the second drum 50 may rotate so that the intensity or amount of the ascending flowing water on the inner wall of the second drum 50 at the smaller spacing portion C2 is greater or stronger than those at the larger spacing portion C1. In this case, a larger amount of the water stream may fall at a strong force toward the center of the drum via the guiding by the guide rib 531. When the guide rib 531 is additionally formed at the larger spacing portion C1, the amount of ascending and then falling water stream is then dispersed. Thus, the amount of the falling water stream decreases and the intensity of the falling water stream decreases. Fewer blows with stronger water streams are more effective in terms of wash effectiveness than multiple blows with weaker water streams.

In one embodiment, a height of the washing water when the wash water passes through an imaginary cross-section from the center of the second drum body 53 to the smaller spacing portion C2 is larger than that when the wash water passes through the imaginary cross-section from the center of the second drum body 53 to the larger spacing portion C1. Thus, even when the second drum 50 rotates at a relatively low speed, the guide rib 531 may lift up the sufficient amount of the washing water.

Further, one face of the guide rib 531 where the guide rib collides with the washing water, and the other face located opposite said one face may be formed with an upward slope toward the direction of the washing water, respectively. That is, when the guide rib 531 is viewed along the radial direction from the center of the second drum body 53, the width of the lower cross-section thereof may be greater than the width of the upper cross-section thereof. Thus, the washing water may more easily rise up along the one face and the other face of the guide rib 531.

According to the experiment, when a length dimension of the second drum 50 is 399 mm and the height of the second drum is 309.2 mm in FIG. 3, a configuration in which the height H of the guide rib 531 is 70 mm and the width W of the guide rib is 65 mm exhibits high washing power in conjunction with an inclined guide 581 to be described later. An experiment is executed in a state in which the dimension values were the same as the above values except that the height H of guide rib 531 was set to 50 mm and 90 mm, respectively. Experimental results show that although more excellent washing power is exhibited in terms of removing some pollutants, an average value of the washing power is lower than a value of the washing power when the height H of the guide rib 531 is set to 70 mm. By way of example, these dimension values are only examples set from the experiments. Specific dimension values of the second drum 50 and the guide rib 531 are not limited thereto.

Each guide rib 531 is provided in each of the smaller spacing portions C2 as described above. That is, a pair of guide ribs has been described, but the present disclosure is not limited thereto. Each guide rib is further mounted on each of the larger spacing portions C1. Thus, a total of two pairs of guide ribs may be formed.

Since the pulsator is not connected to the second drum 50, it is difficult for the second drum to generate the water flow by itself. That is, it is difficult for the second drum to generate strong water flow at a normal washing RPM. Therefore, strong water flow may be achieved using the guide rib 531. Thus, the washing effect by the second drum 50 may be enhanced.

The inclined guide 581 is provided above the guide rib 531 and formed to be inclined downward toward the inside of the second drum 50. Specifically, the inclined guide 581 is formed along the inner side, that is, an inner peripheral surface of the laundry inlet 580 located above the guide rib 531. Thus, the laundry inlet 580 is defined by the inclined guide 581. A radius of the laundry inlet 580 may become smaller as it goes downwardly along the second drum 50.

When the inclined guide 581 is absent, washing-water elevated by the guide rib 531 is moved 51 through an upper portion of the inner circumferential surface of the second drum body 53 and along a bottom face of the second drum cover toward the center of the second drum body 53 and then falls freely into the inside of the second drum body 53.

When the inclined guide 581 is installed, washing-water does not fall freely. That is, the wash-water moves horizontally along the bottom face of the second drum cover 51 and then rapidly diverges downwardly via encountering a lower face of the inclined guide 581. This flow is denoted by a reference numeral 45. That is, a portion of the horizontal direction velocity component is converted into a vertical direction velocity component. The washing-water whose the direction of movement suddenly changes more strongly collides with the laundry received in the second drum body 53 than when water falls freely.

In this connection, an inclination angle θ of the inclined guide 581 with respect to the direction in which gravity acts may be set to approximately 10 degrees. The angle at which the moving direction of washing-water is changed is larger than the inclination angle. As a result, a very strong impact is transmitted to the laundry received in the second drum body, thereby increasing the washing power. The falling position and/or angle of the washing-water may be determined by the inclined guide 581. Further, the washing-water may be prevented from splashing out through the laundry inlet 580. The inclination angle θ is approximately 10 degrees. However, this numerical value is merely an example. The present disclosure is not limited to the numerical value.

In one example, when the second drum 50 rotates at a very high rotational speed, the washing-water received inside the second drum 50 collides with each other and bounces toward the laundry inlet 580 side. In this connection, the inclined guide 581 serves to guide the bounced washing water along its top face to move into the second drum 50.

Hereinafter, a configuration in which the second drum 50 is detached from or attached to the first drum 30 will be described with reference to FIG. 5 and FIG. 6. FIG. 5 is a partially cutaway perspective view showing the inner circumferential surface of a first drum cover 31 to illustrate the first convex-concave portion 315. FIG. 6 is a partial perspective view showing the outer circumferential surface of the second drum 50 to illustrate a second convex-concave portion 535.

Referring to FIG. 5 and FIG. 6, the first drum 30 includes a first convex-concave portion 315 formed on the inner circumferential surface thereof. The second drum 50 includes a second convex-concave portion 535 formed on the outer circumferential surface thereof and configured to be engaged with the first convex-concave portion 315.

Specifically, the second convex-concave portion 535 is formed on the contact portion C1 of the outer circumferential face of the second drum body 53, while the first convex-concave portion 315 is formed on the inner circumferential face of the first drum cover 31. The second convex-concave portion 535 is preferably not formed on the outer circumferential face of the second drum cover 51. This is because, otherwise, the second drum cover 51 may be separated from the second drum body 53 due to the weight of washing-water and laundry received in the second drum body 53.

The first convex-concave portion 315 includes at least one first convex portion 316, at least one first concave portion 317, and a first inclined connection portion 318 for connecting the first convex portion 316 and the first concave portion 317. The first inclined connection portion 318 may not be curved but flat.

The first convex portion 316 is formed to be convexly curved upwards. The first concave portion 317 has a shape corresponding to the first convex portion 316 and is formed to be concavely curved downwards.

The second convex-concave portion 535 is formed in a shape corresponding to the shape of the first convex-concave portion 315. The second convex-concave portion 535 includes at least one second convex portion 536, at least one second concave portion 537 corresponding to at least one second convex portion 536 and formed in a concave shape, and a second inclined connection portion 538 connecting the second convex portion 536 and the second concave portion 537.

The second convex portion 536 is curved downwardly convexly. The second concave portion 537 has a shape corresponding to the second convex portion 536 and is formed to be concavely curved upwards.

The second convex-concave portion 535 is formed in a shape corresponding to the first convex-concave portion 315. When the second drum 50 is seated on the first drum 30, the second convex portion 536 is seated on the first concave portion 317, while the second concave portion 537 rests on the first convex portion 316.

A peak of the second convex portion 536 and a peak of the first convex portion 316 each has a substantially horizontal portion. When the user tries to seat the second drum 50 on the first drum 30, there is a problem that when these horizontal portions meet each other, the second convex portion 536 is not easily seated on the first concave portion 317.

For example, when a peak curvature of each of the curved portions of the first convex portion 316 and the second convex portion 536 is too small, the horizontal portion may occupy a large area. Thus, when the user tries to seat the second drum 50 on the first drum 30, the second convex portion 536 may not be seated on the first concave portion 317 and may be seated on the peak of the first convex portion 316.

However, when each the peak curvatures of the curved portions of the first convex portion 316 and the second convex portion 536 are sufficiently large, and when these horizontal portions meet each other, the second convex portion 536 may slide along the first inclined connection portion 318 to be seated easily on the first concave portion 317.

Accordingly, the size and shape of the first convex-concave portion 315 and the second convex-concave portion 535 need to be appropriately adjusted. For example, as for the second convex-concave portion 535, five second protrusions 754 are formed on each of the two contact portions C1. A spacing between the second protrusions 754 is approximately 35 mm. A length from the lowermost end of the second concave portion 537 to the peak of the second convex portion 536 may be approximately 17.5 mm.

In one example, as the second convex-concave portion 535 engages the first convex-concave portion 315 and seats on the first convex-concave portion 315, the second drum 50 is rotated by the rotational force of the first drum 30. In this case, for example, when the first drum 30 rotates at a high speed, the second convex portion 536 may move upward along the first inclined connection portion 318. Accordingly, the second drum 50 may be disengaged from the first drum 30 due to the high-speed rotation of the first drum 30.

This phenomenon may occur when the inclined angle of the first inclined connection portion 318 is too large with respect to the gravitational direction. To prevent this phenomenon, for example, the first inclined connection portion 318 may be formed to be inclined by about 10 degrees with respect to the gravity direction.

The second inclined connection portion 538 is likewise formed to be inclined by about 10 degrees with respect to the direction of gravity. Thus, the frictional force between the second inclined connection portion 538 and the first inclined connection portion 318 when they are in close contact with each other may be increased.

The second inclined connection portion 538 may extend parallel to the direction of gravity. In this case, when the second drum 50 seats on the first drum 30, the second drum may collide with the first drum 30. Therefore, such a configuration is not preferable.

While the second drum 50 is seated on the first drum 30, the second drum is fastened to the first drum 30 via the locking mechanism 90 which will be described later. Thus, it is possible to prevent the first drum 30 from being separated from the first drum 30.

The contact portion C1 of the second drum cover 51, that is, the larger spacing portion C1 thereof seats on the inner circumferential face of the second drum 50. The spaced portion C2, i.e., the smaller spacing portion C2 thereof is spaced from the outer circumferential face of the second drum 50. Therefore, when the second drum 50 rotates at a high speed, the smaller spacing portion C2 may oscillate up and down, unlike the larger spacing portion C1, due to the position of laundry and washing-water as biased. In other words, when the longest distance between the larger spacing portions C1 of the second drum body 53 is regarded as a length, a kind of rolling phenomenon may occur.

In this connection, each of the first convex portion 316, the first concave portion 317, the second convex portion 536, and the second concave portion 537 is formed to be angled, the first convex portion 316 and the second convex portion 536 may rotate slightly in the second concave portion 537 and the first concave portion 317, respectively due to the rolling phenomenon. Thus, the angled portions of the first convex portion 316 and the second convex portion 536 may cause stress to concentrate on portions of the second concave portion 537 and first concave portion 317, resulting in brittle fracture. Thus, loads of the curved first concave portion 316 and the second convex portion 536 and the curved second concave portion 537 and the first concave portion 317 having the same curvature as those of the curved first concave portion 316 and the second convex portion 536 are uniformly dispersed, thereby significantly preventing the stress concentration. Thus, excellent strength is secured.

When the rolling phenomenon occurs, the first convex portion 316 and the second convex portion 536 may be relatively easily rotated while being received within the second concave portion 537 and the first concave portion 317, respectively since the first convex portion 316 and the second convex portion 536 are formed to be curved. Accordingly, the first convex portion 316 and the second convex portion 536 are separated from the second concave portion 537 and the first concave portion 317, and then rise slightly along the second inclined connection portion 538 and the first inclined connection portion 318. As a result, the contact areas of the first convex portion 316 and the second convex portion 536 may be slightly reduced. As a result, the stress is still concentrated.

Therefore, in order to prevent the rolling phenomenon that the larger spacing portion C1 of the second drum body 53 vibrates up and down, both first tilting-preventing portions 319, and both second tilting-prevention portions 539 in a face contact with the first tilting-preventing portion 319 may be provided both ends of the first convex-concave portion 315 and both ends of the second convex-concave portion 535 respectively.

This first tilting-preventing portion 319 protrudes from the inner circumferential face of the first drum cover 31, like the first convex-concave portion 315. The first tilting-preventing portion 319 further extends in the direction in which the second drum 50 rotates. The first tilting-preventing portion 319 has a top face that is flat to face-contact the second tilting-prevention portion 539.

The second tilting-preventing portion 539 protrudes from the outer circumferential face of the second drum body 53, like the second convex-concave portion 535. The second tilting-preventing portion 539 extends parallel to the direction in which the first tilting-preventing portion 319 extends.

The second tilting-prevention portion 539 has a bottom face in a face contact with the top face of the first tilting-prevention portion 319.

Hereinafter, an example of the water discharge mechanism 70 will be described in detail with reference to FIGS. 7 to 9. FIG. 7 is a partial cross-sectional view along a line B-B shown in FIG. 4 to illustrate the water discharge mechanism. FIG. 8 is an enlarged view of a part D of FIG. 7 to illustrate an example of a water discharge mechanism. FIG. 9 is a partial cut-away plan view to illustrate the water discharge mechanism shown in FIG. 8.

Referring to FIGS. 7 to 9, a pair of water discharge mechanisms 70 are adjacent to a pair of first curvature portions C1, that is, a pair of larger spacing portions C1 respectively. The water discharge mechanism 70 selectively discharges the washing water to the outside of the second drum 50 according to the magnitude of the centrifugal force due to the rotation of the second drum 50.

The water discharge mechanism 70 includes a water receiving hole 77 for receiving washing-water rising along the inner circumferential face of the second drum body 53, a check valve 71 for selectively passing therethrough washing water having passed through the water receiving hole 77, chambers 732 and 733 acting as flow resistance against washing-water having passed through the check valve 71, through-holes 735 and 737 for communicating between the chambers 732 and 733, a water-discharging hole 79 for discharging washing-water having passed through the chambers 732 and 733 to the outside of the second drum 50, and a seat portion 75 on which the check valve 71 is seated.

The seat portion 75 may be provided at the edge of the second drum cover 51. In addition, the seat portion 75 may extend radially inwardly from the side wall of the second drum. The height of the seat portion is determined such that wash water may be introduced into the water discharge mechanism 70 even when the washing-water rises up to a certain height along the inner circumferential face of the second drum body 53. Considering that the highest water level of washing-water is set to be lower than the second drum cover 51, the seat portion 75 may be formed to be positioned below the top face of the second drum cover 51 as shown in FIG. 7.

The seat portion 75 includes a vertical extension 751 extending downward from the top face of the second drum cover 51, and a horizontal extension 752 extending approximately horizontally from one end of the vertical extension 751 towards an edge of the second drum 50. The vertical extension 751 extends downward from the bottom of the recess 561.

The horizontal extension 752 defines the bottom face of the seat portion 75 and is connected to the lower end of the vertical extension 751. The horizontal extension 752 has a first protrusion 753 and a second protrusion 754 projecting upwards. The first protrusion 753 is inserted into a receiving hole 717 of the check valve 71 to be described later. The second protrusion 754 interferes with a rotatable portion 713, which will be described later.

A water receiving hole 77 is formed in the horizontal extension 752. The hole 77 is formed adjacent to an inner circumferential face of the second drum body 53 to receive washing-water rising along the inner circumferential face of the second drum body 53.

The check valve 71 is seated on the seat portion 75. One end of the check valve contacts the inner circumferential face of the second drum body 53. The check valve 71 includes a shrinkable portion 711 that shrinks by centrifugal force, a slit 712 formed to pass through the shrinkable portion 711 and allowing washing-water to pass therethrough, a rotatable portion 713 connected to the shrinkable portion 711 and rotating in the direction of centrifugal force, and a horizontal support 715.

One end of the shrinkable portion 711 contacts the inner circumferential face of the second drum body 53. The shrinkable portion 711 is made of a soft material so that it can be shrunk by externally applied force. In this connection, the external force refers to the centrifugal force due to the rotation of the second drum 50.

The shrinkable portion 711 may be oriented at various angles on the seat portion 75. The shrinkable portion 711 extends along the direction in which the centrifugal force acts such that the shrinkable portion 711 sufficiently shrinks when the centrifugal force acts. A plurality of shrinkable portions 711 may be arranged along the outer circumferential face of the second drum cover 51, as shown in FIG. 9.

The slit 712 extends through the shrinkable portion 711. The slit is formed to open via shrinking of the shrinkable portion 711. Particularly, the slit 712 is formed along the direction in which the centrifugal force acts so that the slit 712 is effectively opened when the centrifugal force acts.

When the centrifugal force acts on the shrinkable portion 711, the slit 712 may be opened while both opposite side portions of the slit 712 move in a direction away from the slit 712.

One end of the rotatable portion 713 is connected to the shrinkable portion 711 and the other end thereof is connected to the horizontal support 715. The rotatable portion 713 is formed so as to be perpendicular to the direction in which the centrifugal force acts. In this connection, the horizontal support 715 to be described later is fixed to the seat portion 75.

There may be no rotatable portion 713, and the horizontal support 715 may be fixed to the horizontal extension 752. The horizontal support 715 may be arranged with the shrinkable portion 711 in a side-by-side arrangement in the direction in which the centrifugal force acts. In this case, when the centrifugal force acts, the horizontal support 715 pulls the shrinkable portion 711 in a direction opposite to the direction in which the centrifugal force acts. Thus, there is a problem that the shrinkable portion 711 cannot shrink sufficiently.

In order to solve this problem, one end of the rotatable portion 713 connected to the shrinkable portion 711 is configured to be rotatable using a small force about the other end of the rotatable portion 713 fixed to the seat portion 75. Thus, the rotatable portion 713 serves to allow the shrinkable portion 711 to shrink more smoothly.

The material of the shrinkable portion 711 of the check valve 71 and the length of the rotatable portion 713 thereof may be determined such that the slit 712 may be opened at a spinning rpm higher than the washing rpm.

The horizontal support 715 is configured to be in a face contact with the horizontal extension 752 of the seat portion 75. Below the horizontal support 715, the receiving hole 717 is defined which receive the first protrusion 753 of the seat portion 75. The horizontal support 715 is connected to the other end, which is the center of rotation of the rotatable portion 713.

In one example, a receiving space 731 for receiving wash-water having passed through the check valve 71 is provided above the check valve 71 and below a first chamber 732 as described below. The first chamber 732 is configured for collecting the washing-water moved upward from the receiving space 731. A second chamber 733 is configured for collecting the washing water before the washing-water moved from the first chamber 732 is discharged to the outside through the water-discharging hole 79. The first and second chambers are defined between the water receiving hole 77 and the water-discharging hole 79. A first through hole 735 is defined for communicating the accommodation space 731 with the first chamber 732, while a second through hole 737 is defined for communicating the first chamber 732 and the second chamber 733.

The first through-hole 735 is located at a different longitude from that of the slit 712. The second through-hole 737 is located at a different longitude from that of the first through-hole 735. Thus, even though washing-water passes through the open slit 712, the wash water must travel along a bent flow channel 43 to pass through the first through-hole 735. Even though the wash water also flows through the first through-hole 735, the wash water must travel along the bent flow channel 43 again to pass through the second through-hole 737. This bent flow channel acts as a flow resistance against the flowing washing-water.

Therefore, when the second drum 50 rotates at the washing rpm, the bent flow channel acts as a flow resistance against the washing-water rising along the inner circumferential face of the second drum 50. Thus, the washing-water may not be discharged to the outside. Further, when the second drum 50 rotates at a spinning rpm greater than the washing rpm, the washing-water rising along the inner circumferential face of the second drum 50 may overcome the resistance resulting from the bent flow channel 43 and be discharged to the outside. That is, as the water discharge mechanism 70 has the bent flow channel 43 therein, the water discharge mechanism 70 may selectively discharge the washing-water based on the magnitude of the centrifugal force. In one example, the receiving space 731, first chamber 732, and second chamber 732 may collect lint as removed from the laundry.

Hereinafter, another example of the water discharge mechanism 80 will be described in detail with reference to FIG. 10. FIG. 10 is an enlarged view of a part D of FIG. 7 to illustrate another example of a water discharge mechanism 80.

Except for a horizontal extension 852 having a water receiving hole 87 defined therein as exemplified below, this example has the same structure as the above example. Therefore, the same reference numeral is assigned to the same component between this example and the above-mentioned example. Detailed description thereof will be omitted.

The seat portion 85 is included in the water discharge mechanism 80 of the second drum 50 and extends radially inwardly from the side wall of the second drum 50. The hole 87 is defined in the seat portion 85 so that the water receiving hole 87 receives washing-water inside the second drum 50. The hole 89 is defined in the side wall of the second drum 50 so that the washing-water is discharged to the outside of the second drum 50 therethrough. Accordingly, the water discharge mechanism 80 may selectively allow the washing-water to be introduced into the interior through the water receiving hole 87 or allow the washing-water introduced through the water receiving hole 87 to be discharged to the outside of the second drum 50 through the water-discharging hole 89, depending on the magnitude of the centrifugal force due to the rotation of the second drum 50.

In this connection, a water-discharging hole 89 is defined more radially and inwardly of the second drum 50 than the water receiving hole 87 is defined. The hole 89 is defined at a position higher than a position of the water receiving hole 87. Accordingly, after the washing-water rises through the water receiving hole 87, the wash water may be moved radially and outwardly of the second drum 50 and then discharged through the water-discharging hole 89. A plurality of water receiving holes 87 may be arranged along the circumferential direction of the second drum 50. The hole 87 may be formed in a circular hole or slit shape.

The total area of the water receiving hole 87 is smaller than the area of the bottom face of the seat portion 85 where the washing-water collides. Thus, a first resistance is generated when washing-water is introduced into the water receiving hole 87. Furthermore, the water-discharging hole 89 is positioned more radially and outwardly than the water receiving hole 87. Thus, when washing-water flows from the water receiving hole 87 to the water-discharging hole 89, a second resistance is generated. Thus, at a washing RPM lower than the spinning RPM, washing-water is not discharged from the inside of the second drum 50. Furthermore, washing-water may be selectively discharged only in a predetermined spinning RPM band. This selective discharge may be realized without components to be controlled, such as a drain valve or a drain pump.

In one example, the hole 87 may be formed in the bottom face of the seat portion 85 such that the water receiving hole 87 is spaced by a predetermined distance S radially inwardly from the inner wall of the second drum 50. The predetermined distance S may be determined by various factors such as the capacity, shape, diameter, depth, etc. of the second drum 50.

When the second drum 50 receiving washing-water rotates, a first resistance may occur in which the washing-water moving radially outward due to the centrifugal force overcomes the centrifugal force and moves radially inwards. The total area of the water receiving hole 87 is smaller than the area of the bottom face of the seat portion 85 where washing water collides. Thus, when the washing-water flows into the water receiving hole 87, a second resistance may occur in which a sixth flow 46 is generated. Thereafter, since the water-discharging hole 89 is positioned more radially outwardly than the water receiving hole 87, a third resistance may occur in which a third flow 43 is generated when the water flows from the water receiving hole 87 to the water-discharging hole 89.

In addition, as with the water discharge mechanism 70 according to the above-described example, the water discharge mechanism 80 according to the present embodiment includes first and second chambers 732 and 733, a through-hole 738 defined in the spacer wall between the first and second chambers 732 and 733, and a through-hole 735 defined in the spacer wall defining the first chamber and the receiving space. The through-holes 735 and 738 are defined at different longitudes. Accordingly, the bent flow channel 73 is defined between the water receiving hole 87 and the water-discharging hole 89. Thus, an additional resistance is generated against washing-water passing through the bent flow channel 73. Furthermore, as the water-discharging hole 89 is located at a vertical level higher than the water receiving hole 87, an additional resistance due to gravity may occur when the washing-water rises.

In one example, the water-discharging hole 89 may be formed in a slit shape elongated in the circumferential direction of the second drum 50. As the water-discharging hole 89 is formed in the shape of the slit, the washing-water rising along the inner wall of the second drum 50 passes at least once through the water-discharging hole 89, before reaching the top face of the second drum 50. Accordingly, when the water-discharging hole 89 is formed in the shape of a slit, the washing-water can be more smoothly discharged and less washing-water remains in the water discharge mechanism 80 as compared with a case where the water-discharging hole 89 is formed in a circular shape.

In one example, the second drum 50 may include a second drum body 53 receiving washing-water and laundry, and the second drum cover 51 as described above. The second drum cover 51 may include a lower cover 54 coupled to the top of the body of the second drum 50, and an upper cover 55 coupled to the top of the lower cover 54.

The lower cover 54 has a seat portion 85 to seat the upper cover 55 thereon. The seat portion 85 extends radially inwardly from the side wall of the lower cover. The seat portion 85 includes horizontal and vertical extensions. The horizontal extension defines the bottom face of the seat portion 85. The first protrusion 753, the second protrusion 754, and the receiving hole 857 provided in the horizontal extension have the same functions as those of the water discharge mechanism 70 according to the above-described example.

In one example, a first chamber 732 or a second chamber 733 may be defined in the upper cover 55. As the upper cover 55 is coupled to the lower cover 54, the receiving space 731 may be defined. However, the present disclosure is not limited thereto. A receiving space 731 is defined in the lower cover 54. The first chamber 732 is defined as the lower cover 54 and the upper cover 55 are coupled to each other. Alternatively, a receiving space 731 and a first chamber 732 are defined in the lower cover 54. As the lower cover 54 and upper cover 55 join together, a second chamber 733 may be defined.

The water receiving hole 87 receiving washing water in the second drum 50 is defined in the horizontal extension so that the hole 87 is spaced by a predetermined distance S from the side wall of the lower cover 54. The water-discharging hole 89 is formed in the side wall of the lower cover 54 such that the washing-water is discharged to the outside of the second drum 50 through the hole 89. Accordingly, the water discharge mechanism 80 may selectively allow the washing-water to flow inwardly through the water receiving hole 87, or allow the washing-water to be discharged through the water-discharging hole 89 to the outside of the second drum 50, depending on the magnitude of the centrifugal force due to the rotation of the second drum 50.

Hereinafter, a locking mechanism 90 is illustrated in detail with reference to FIG. 11 and FIG. 12. FIG. 11 is a partial cross-sectional view along a line C-C shown in FIG. 4 to illustrate the locking mechanism 90. FIG. 12 is a perspective view to illustrate the locking mechanism 90.

Referring to FIGS. 11 and 12, the locking mechanism 90 serves to prevent the second drum from being separated from the first drum when the second drum 50 is rotated at a high speed after being mounted on the first drum 30.

The locking mechanism 90 includes a stopper 312 protruding from the inner circumferential face of the first drum 30, fixing means 93 coupled to the stopper 312 to limit the vertical movement of the second drum 50, a first frame 95 provided above the fixing means 93 and a second frame 97 configured to be slidable in the vertical direction.

The stopper 312 protrudes from the inner circumferential face of the first drum 30. The stopper includes a downwardly bent portion 313 extending downwardly to be bent and an upper inclined portion 314 defining the upper portion of the stopper 312 and formed to be inclined downward toward the inner circumferential face of the second drum 50.

The downwardly bent portion 313 prevents the fixing means 93 from moving upward while a distal end of the downwardly bent portion 313 abuts the top face of the fixing means 93. In addition, the downwardly bent portion 313 may effectively prevent the second drum 50 from being separated upwards from the first drum 50 even when the stopper 312 is bent upward due to the up-and-down vibration of the second drum 50.

For example, when the stopper 312 is bent upward in a certain angle range, the distal end of the downwardly bent portion 313 moves toward the second drum cover 51 while rotating upwardly. Thus, the point of contact between the stopper 312 and the fixing means 93 moves to the inside of the second drum cover 51 along the top face of the fixing means 93.

If the stopper 312 does not include the downward bent portion 313, the point of contact between the stopper 312 and the fixing means 93 will move out of the second drum cover 51 along the top face of the fixing means 93 as the stopper 312 is bent upwards, and will then deviate from the fixing means 93 at a certain point in time.

The upper inclined portion 314 is formed at a smaller height than the water-discharging hole 79. The upper inclined portion 314 is formed such that some washing-water falling into the upper inclined portion 314 from the washing-water as discharged from the water-discharging hole 79 rises up along the inclined surface and then is discharged into the tub 20 without being discharged to the first drum 30.

The fixing means 93 is received in the second drum cover 51 so that a portion thereof may be inserted and withdrawn into and from the second drum cover. When the fixing means 93 is withdrawn from the second drum cover 51, a top face thereof is interfered by a bent portion of the stopper 312. Thus, upward movement of the second drum 50 is restricted.

The fixing means 93 includes a fixing means body 931 formed in a bar shape, a rack 933 formed on a top face of the fixing means body 931 and engaged with a pinion 934, and an upper convex portion 937 formed on the top face of the fixing means body 931.

A tip of the fixing means body 931 is projected to the outside of the second drum cover 51. The fixing means body 931 is inserted into and withdrawn from the second drum cover 51 while reciprocating via forward and reverse rotation of the pinion 934 engaged with the rack 933.

The rack 933 is formed on the top face of the distal end of the fixing means body 931. With the rack being engaged with the pinion 934, the rack serves to convert the rotational motion of the pinion 934 into a linear motion.

In one example, the pinion 934 is provided under the first frame 95. The pinion is rotatably connected to the first frame 95 via a first pin 936. The pinion is connected to the second frame 97 via a pinion connector and receives a force from the second frame 97.

The pinion connector includes a first pinion connector 935 formed on one side of the pinion 944 and a second pinion connector **973*b* coupled to the second frame 97**.

The first pinion connector 935 projects radially from the outer circumferential face of the pinion 934. The first pinion connector 935 may be fixed to the outer circumferential face of the pinion 934 and may be made integral with the pinion 934.

The second pinion connector **973*b* is rotatably connected to the first pinion connector 935 via a second pin. The second pinion connector 973*b* is connected to the second frame 97** in a reciprocating linear motion manner.

Thus, the pinion 934 rotates in conjunction with the reciprocating linear motion of the second frame 97.

The upper convex portion 937 is interfered by the tension bar 957 of the first frame 95. Thus, the upper convex portion 937 allows the fixing means 93 moved to the outside of the second drum cover 51 via the rotation of the pinion 934 to be inserted again into the second drum cover 51.

The first frame 95 is provided above the fixing means 93 and is formed into a bar shape. Furthermore, a top face of the first frame 95 defines a portion of the side face of the recess 561, a portion of the bottom face of the recess, and a portion of the outer face of the second drum cover 51. Accordingly, the first frame 95 has upwardly bent portions at both ends thereof respectively. In one example, a flange is formed on each of both sides of the first frame 95 such that the first frame is coupled to the second drum cover 51.

The first frame 95 includes a first bent portion 951 bent at one end, a pair of second bent portions 953 bent upward at the other end, a side hole 955 defined in the first bent portion 951 for receiving the fixing means 93, a tension bar 957 projecting from the bottom face of the first frame 95, a pair of horizontal guides 958 protruding from the bottom face of the first frame 95 and a pinion support that rotatably supports the pinion 934.

A top face of the first bent portion 951 is upwardly bent once to define the bottom and a portion of the side face of the recess 561. In addition, the top face of the first bent portion 951 is bent downwardly again so as to define a portion of a side face of the second drum cover 51. The downwardly bent first bent portion 951 extends downwardly to the vertical level at which the fixing means 93 is located. In the distal end of the first bent portion 951, a side hole 955 is defined which allows the fixing means 93 to pass therethrough.

The tension bar 957 is disposed in the concave space downwardly of the first bent portion 951 and extends downwardly. The tension bar 957 is made of elastic material. The length of the tension bar 957 is adjusted according to the height of the concave space. Accordingly, the elastic force transmitted to the upper convex portion 937 may also be adjusted.

The horizontal guide 958 extends downwardly from the bottom face of the first frame 95. A distal end of the guide 958 is properly spaced from the fixing means 93. The horizontal guide 958 allows the fixing means 93 to maintain a horizontal state. That is, when the fixing means 93 reciprocates in the longitudinal direction, the horizontal guide 958 prevents one of the sides of the fixing means from tilting.

A pair of pinion supports 959 may be provided. The pinion support supports, in a rotatable manner, the first pin 936, which passes through the center of rotation of the pinion 934.

A pair of second bent portions 953 are provided, whereby the other end of the first frame are formed in a Y-shape. The second bent portion 953 is disposed below the handle portion 510. A distal end of the second bent portion 953 interferes with the bottom of the first curved portion 971 to be described below, thereby limiting the downward movement of the second frame 97 within a certain range. Accordingly, the second bent portion 953 may be referred to as a stopper.

A top face of each of the two second bent portions 953 define a top face and a portion of a bottom face of the recess 561. Furthermore, a pair of second bent portions 953 define a water supply hole 562 together with the first curved portion 971.

The second frame 97 is formed in a shape of a rectangular frame having a hollow portion defined therein. The second frame is disposed below the handle portion 510. The second frame 97 is coupled to the second drum cover 51 to be vertically slidable.

The second frame 97 includes a first curved portion 971 that contacts the bottom of the handle portion 510, a pair of vertical portions 975 that support the first curved portion 971, and a second curved portion 973 that supports the pair of vertical portions 975 and is disposed below the first curved portion 971.

The first curved portion 971 is partially inserted into a recess formed in a bottom of the handle portion 510. That is, a middle portion of the first curved portion 971 is partially inserted into a lower recess of the handle portion 510.

Both ends of the first curved portion 971 are supported by the pair of vertical portions 975. A middle portion of the first curved portion 971 is curved toward the outside of the second drum cover 51.

The vertical portion 975 is disposed below the first curved portion 971. The vertical portion 975 is fixed to both ends of the first curved portion 971. The vertical portion 975 is movably coupled to the second drum cover 51 so that the second frame 97 can be moved up and down. That is, the vertical portion 975 is coupled to the second drum cover 51 through a slit groove 975*a* defined in a direction extending up and down in one side face thereof.

Both ends of the second curved portion 973 are fixed to the pair of vertical portions 975, thereby supporting the pair of vertical portions 975. The second curved portion 973 is curved toward the outside of the second drum cover 51. The second pinion connector 973*b* is disposed on the middle of the second curved portion 973.

The second pinion connector 973*b* is coupled to the second curved portion 973 so as to reciprocate linearly. The second pin 973*a* is rotatably coupled to one side of the second pinion connector 973*b*. The second pin 973*a* is rotatably coupled to one end of the first pinion connector 935.

Thus, when the second curved portion 973 rises up together with the pair of vertical portions 975 without horizontal movement, this may rotate the pinion 934.

In one example, when the user grasps the first curved portion 971 together with the handle portion 510 and exerts an upward force, the entire second frame 97 slides upward to allow the pinion 934 to be rotated. This may allow inserting or withdrawing the fixing means 93 into and out of the drum cover. Thus, the first curved portion 971 may be referred to as an actuating portion 971.

The following will sequentially illustrate an operation of the laundry treating apparatus 1 constructed as described above with reference to the drawings.

First, the user separates the laundry, which is not suitable for washing together, into two groups and puts them in the first drum 30 and the second drum 50, respectively.

The user then grasps the handle portion 510 of the second drum 50 and seats the second drum 50 on the top of the first drum 30 such that the second drum 50 is engaged with the first drum 30.

The user applies force to the actuating portion 971 when pushing the handle portion and pushes the portion 971 into the handle portion. As a result, the second frame 97 rises up.

The second pinion connector 973*b* rises up together with the second frame 97. IN this connection, the second pinion connector 973*b* rises up along a curved path, unlike the second frame 97, which rises up along a straight path. In other words, the second pinion connector 973*b* moves right and then left while moves up in FIG. 12.

The pinion 934, which is connected to the second pinion connector 973*b* via the first pinion connector 935, rotates counterclockwise in FIG. 11.

While the fixing means 93 connected to the pinion 934 via the rack 933 move to the right in FIG. 12, the tip of the fixing means 93 is inserted into the second drum cover 51. Accordingly, the second drum 50 may descend into the first drum 30 without mutual interference between the fixing means 93 and the stopper 312. When the second drum 50 descends, the second convex-concave portion 535 seats on the first convex-concave portion 315. This process may allow the second drum 50 to be seated on the top of the first drum 30.

When the second drum 50 is seated on the first drum 30, the user releases the force applied to the actuating portion 971. The fixing means 93 moves to the left via the elastic force that the tension bar 957 applies to the upper convex portion 937 in the left direction. As a result, the fixing means 93 is pulled out of the drum cover. As a result, the pinion 934 rotates clockwise in FIG. 12. The pair of vertical portions 975 and pair of the second curved portions 973 are lowered, whereby the actuating portion 971 returns to its original position.

When the second drum 50 is seated on the top of the first drum 30 and engaged with the first drum 30, the water supply 18 begins to supply the water to the first drum 30 and the second drum 50, respectively.

First, the first drum 30 starts rotating. The second drum 50 receives the rotational force from the first drum 30 via the first convex-concave portion 315 and the second convex-concave portion 535 and rotates together with the first drum 30.

In this connection, the first drum 30 rotates by a predetermined angle so that the inner water-supply guide 560 is positioned below the water supply 18. When the inner water-supply guide 560 is located below the water supply 18, the water supply 18 begins to supply wash-water with detergent dissolved therein. The supplied washing-water temporarily stays in the recess 561 and then is supplied into the second drum body 53 through the second water-supply channel 562.

When the water supply to the second drum body 53 is completed, the first drum 30 is again rotated by a predetermined angle so that the outer water-supply guide 570 is positioned below the water supply 18. When the outer water-supply guide 570 is positioned below the water supply 18, the water supply 18 starts the water supplying. The supplied washing-water impinges on the outer water-supply guide 570 and is thus fed into the tub 20 along the first water-supply channel 573. The washing water supplied into the tub 20 is injected into the first drum 30 through the holes 33.

When the water supply is completed, the first drum 30 begins to rotate in order to perform a washing process, that is, a washing cycle, a rinse cycle and a spinning cycle. The second drum 50 receives the rotational force from the first drum 30, thereby rotating at the same rotational speed as the first drum 30.

When the second drum 50 rotates, the washing-water received inside the second drum 50 rotates along the inner circumferential face of the second drum body 53. Since the transverse section of the second drum 50 is formed in an elliptical shape, a vortex is formed in the second drum. Accordingly, the frictional force between laundry is increased, and, thus, the washing power may increase.

In one example, as a rotational speed of the second drum 50 increases, washing-water rises slowly as it rotates along the inner circumferential face. Thus, a fifth flow 45 as described below is generated.

The washing-water, which has begun to slowly rise, clashes with the guide rib 531 and rises up rapidly. Then, the washing-water moves along an upper portion of the inner circumferential face of the second drum body 53 and then moves horizontally along the bottom face of the second drum cover 51. Thereafter, the washing water encounters the bottom face of the inclined guide 581 and thus is suddenly changed in a direction thereof downwardly. The washing-water whose the direction of movement is suddenly changed downwards collides with the laundry received in the second drum body 53 at a high speed. This fifth flow of the washing-water raises the washing power.

In one example, the washing-water inside the second drum 50 rotating at a high speed partially rises up via collision with each other. The elevated wash water then falls onto the inclined guide 581 formed on the laundry inlet 580. Thus, the water is collected by the second drum 50. In this way, the sixth flow 46 is generated.

Only the larger spacing portion C1 of the second drum 50, that is, the contact portion C1 thereof is engaged with the first drum 30. Thus, When the second drum 50 rotates at a high speed while the position of the laundry is biased, the smaller spacing portion C2, that is, the spaced portion C2 oscillates up and down. Thus, the rolling phenomenon may occur. In this connection, the rolling phenomenon may be mitigated by the first and second tilting-preventing portions 319 and 539.

In one example, the angles of the first inclined connection portion 318 and the second inclined connection portion 538 are set to approximately 10 degrees with respect to the gravitational direction. Therefore, even when the first drum 30 rotates at a high speed, the second inclined connection portion 538 rises up along the first inclined connection portion 318. Thus, the second drum 50 may be not easily removed from the first drum 30.

Even when the first drum 30 rotates at the high speed so that the second inclined connection portion 538 rises up along the first inclined connection portion 318, the top face of the fixing means 93 is pressed downwardly by the bent portion of the stopper 312. Thus, the second drum 50 is not released from the first drum 30.

When performing the washing process, a normal spinning cycle and a provisional spinning may be carried out. In this connection, the washing-water should be discharged from the second drum 50 to the outside. Since the first drum and the second drum receive laundry groups respectively which are sorted based on the type and size thereof, it is not advisable to discharge the washing-water from the second drum 50 to the first drum 30.

When the second drum 50 rotates at a high speed for the spinning cycle, the washing-water is discharged to the outside through the water discharge mechanism 70.

Specifically, a first flow 41 is created in which washing-water rises up along the inner circumferential face of the second drum 50.

Thereafter, the washing-water passes through the water receiving hole 77 and then moves to the check valve 71. In this way, a second flow 42 is generated. The second flow 42 does not pass through the check valve 71 until the second drum 50 rotates at a high speed.

When the second drum 50 rotates at a high speed, the check valve 71 opens and thus the washing-water generates a third flow 43.

Thereafter, a fourth flow 44 is generated in which the washing-water is discharged to the outside of the second drum 50 through the water-discharging hole 79. A portion of the fourth flow 44 rises up along the upper inclined portion 314 and then is discharged into the tub 20.

As described above, washing-water passes through the open check valve 71 and then is discharged out through the side face of the second drum 50. At this time, the washing water is discharged upwardly of the first drum cover 31. The discharged washing-water moves over the top of the first drum cover 31 by a centrifugal force and is then injected into the tub 20.

The washing-water in the second drum 50 injected into the tub 20 is not injected into the first drum 30 through the holes 33. Rather, the washing water is discharged to the outside of the tub 20 through the drain pump 11.

In one example, the second drum 50 may rotates at a washing rpm lower than the spinning rpm, for a wash cycle other than a spinning cycle. In this connection, washing-water in the second drum 50 should be reserved for the washing cycle. Thus, it is not desirable that the wash water is discharged through the water discharge mechanism 70 to the outside as in the spinning cycle. Thus, taking into account that the rotational speed for the wash cycle is lower than the rotational speed for the spinning cycle, the check valve is configured such that the wash-water cannot easily pass through the check valve 71 at the rotational speed for the washing cycle.

When the washing process is finished, the user may separate the second drum 50 from the first drum 30 in a reverse order to an order in which the second drum 50 is seated on the first drum 30 and coupled to the first drum.

Although the present disclosure has been illustrated by reference to the specific embodiments and drawings, the present disclosure is not limited thereto. It will be apparent to those skilled in the art that the present disclosure is susceptible to various modifications and alternative constructions within the spirit and scope of the present disclosure and equivalents of the appended claims.

What is claimed is:

1. A laundry treating apparatus comprising:

a tub for receiving washing-water therein;

a first drum rotatably disposed within the tub;

a second drum disposed in the first drum so as to be attachable or detachable to or from the first drum, wherein washing of a laundry by the second drum is performed separately from washing of a laundry by the first drum; and a water discharge mechanism mounted on the second drum, wherein the water discharge mechanism includes:

a seat portion extending radially inwardly from a side wall of the second drum, a water receiving hole defined in the seat portion for receiving the washing-water from the second drum, and a water-discharging hole defined in the side wall of the second drum for discharging the washing-water to an outside of the second drum, wherein the water discharge mechanism is configured to selectively allow the washing-water to flow into the water discharge mechanism through the water receiving hole or allow the washing-water received into the water discharge mechanism through the water receiving hole to be discharged to the outside of the second drum through the water-discharging hole, based on a magnitude of a centrifugal force due to a rotation of the second drum, wherein the second drum includes:

a drum body for receiving laundry and the washing-water, and a drum cover disposed on a top of the drum body, wherein the drum cover has a laundry inlet defined therein for receiving laundry, wherein the water-discharging hole is located more radially inwardly of the second drum than the water receiving hole, and wherein the water-discharging hole is located at a vertical level higher than a vertical level of the water receiving hole.

2. The laundry treating apparatus of claim 1, wherein the water discharge mechanism is configured to allow wash-water rising along an inner circumferential face of the second drum to be introduced into the water discharge mechanism and then discharged therethrough to the outside of the second drum.

3. The laundry treating apparatus of claim 2, wherein the water discharge mechanism includes a bent flow channel constructed for lowering a flow pressure of the washing-water.

4. The laundry treating apparatus of claim 3, wherein the water discharge mechanism includes a chamber defining a space for receiving the wash-water introduced through the water receiving hole.

5. The laundry treating apparatus of claim 4, wherein the chamber includes a plurality of chambers, wherein the plurality of chambers are arranged in a vertical direction.

6. The laundry treating apparatus of claim 5, wherein the water discharge mechanism has a plurality of through-holes defined to fluid-communicate the plurality of chambers with each other.

7. The laundry treating apparatus of claim 2, wherein the water discharge mechanism includes a check valve configured for selectively passing therethrough the washing-water from the water receiving hole, based on the magnitude of the centrifugal force due to the rotation of the second drum.

8. The laundry treating apparatus of claim 7, wherein the check valve includes:

a shrinkable portion configured to be shrinkable by the centrifugal force; and a slit extending through the shrinkable portion, wherein when the shrinkable portion is shrunk, the slit is opened to communicate with the water receiving hole.

9. The laundry treating apparatus of claim 1, wherein the water discharge mechanism is mounted on an edge of the drum cover.

10. The laundry treating apparatus of claim 9, wherein the water discharge mechanism includes a bent flow channel constructed to lower a flow pressure of the washing-water.

11. The laundry treating apparatus of claim 10, wherein the water discharge mechanism includes a chamber defining a space for receiving the washing-water introduced through the water receiving hole.

12. The laundry treating apparatus of claim 11, wherein the water discharge mechanism includes a check valve configured for selectively passing therethrough the washing-water from the water receiving hole, based on the magnitude of the centrifugal force due to the rotation of the second drum.

13. The laundry treating apparatus of claim 12, wherein the check valve is seated on the seat portion.

14. The laundry treating apparatus of claim 11, wherein the seat portion is located below a top face of the drum cover.

15. The laundry treating apparatus of claim 11, wherein the water receiving hole contacts the side wall of the second drum.

16. The laundry treating apparatus of claim 1, wherein the water receiving hole is located below the water-discharging hole and contacts an inner face of the side wall of the second drum, wherein the washing-water rising up and flowing through the water receiving hole into the water discharge mechanism moves radially outwardly and then is discharged through the water-discharging hole out of the second drum.

17. The laundry treating apparatus of claim 16, wherein the water receiving hole includes a plurality of circular holes or elongate slits arranged along a circumferential direction of the second drum.

18. The laundry treating apparatus of claim 16, wherein the water discharge mechanism includes the seat portion extending radially inwardly from an inner face of the side wall of the second drum.

19. The laundry treating apparatus of claim 18, wherein the water-discharging hole comprises a slit, wherein a dimension of the slit in a circumferential direction of the second drum is larger than a dimension of the slit in a vertical direction.

20. A laundry treating apparatus comprising:

a tub for receiving washing-water therein;

a first drum rotatably disposed within the tub;

a second drum disposed in the first drum so as to be attachable or detachable to or from the first drum, wherein washing of a laundry by the second drum is performed separately from washing of a laundry by the first drum; and a water discharge mechanism mounted on the second drum, wherein the water discharge mechanism includes:

a seat portion extending radially inwardly from a side wall of the second drum, a water receiving hole defined in the seat portion for receiving the washing-water from the second drum, and a water-discharging hole defined in the side wall of the second drum for discharging the washing-water to an outside of the second drum, wherein the water discharge mechanism is configured to selectively allow the washing-water to flow into the water discharge mechanism through the water receiving hole or allow the washing-water received into the water discharge mechanism through the water receiving hole to be discharged to the outside of the second drum through the water-discharging hole, based on a magnitude of a centrifugal force due to a rotation of the second drum, wherein a transverse section of the first drum has a circular shape and a transverse section of the second drum has an elliptical shape, wherein an inner circumferential face portion of the second drum includes:

a smaller spacing portion spaced from a center of rotation of the second drum by a first spacing; and a larger spacing portion spaced from the center of rotation by a second spacing greater than the first spacing, and wherein the laundry treating apparatus further includes:

a locker for engaging and disengaging the second drum with and from the first drum, wherein the locker is mounted on the larger spacing portion; and a handle portion for providing a grip space for a user to grip the second drum, wherein the handle portion is mounted on the larger spacing portion.

21. The laundry treating apparatus of claim 20, wherein the water discharge mechanism is mounted on the larger spacing portion.

* * * * *